US008316753B2

(12) United States Patent
Beach et al.

(10) Patent No.: US 8,316,753 B2
(45) Date of Patent: Nov. 27, 2012

(54) EXPLOSIVE ROUND COUNTERMEASURE SYSTEM

(75) Inventors: Rodney B. Beach, Goleta, CA (US); Sam Christ Petronakis, Santa Ynez, CA (US); William Gulley, Goleta, CA (US)

(73) Assignee: Innovative Survivability Technologies, Inc., Goleta, CA (US)

( * ) Notice: Subject to any disclaimer, the term of this patent is extended or adjusted under 35 U.S.C. 154(b) by 0 days.

(21) Appl. No.: 13/290,974

(22) Filed: Nov. 7, 2011

(65) Prior Publication Data

US 2012/0048103 A1 Mar. 1, 2012

Related U.S. Application Data

(62) Division of application No. 12/913,698, filed on Oct. 27, 2010, now Pat. No. 8,051,762, which is a division of application No. 10/526,602, filed on Mar. 9, 2005, now Pat. No. 7,827,900.

(60) Provisional application No. 60/618,373, filed on Oct. 7, 2004.

(51) Int. Cl.
*F41H 5/007* (2006.01)

(52) U.S. Cl. ..... 89/36.17; 89/902

(58) Field of Classification Search ..... 89/36.17, 89/902

See application file for complete search history.

(56) References Cited

U.S. PATENT DOCUMENTS

| | | | | |
|---|---|---|---|---|
| 3,893,368 | A * | 7/1975 | Wales, Jr. | 89/36.17 |
| 4,524,697 | A * | 6/1985 | Bocker et al. | 102/517 |
| 4,848,238 | A * | 7/1989 | Bocker et al. | 102/476 |
| 6,327,955 | B1 * | 12/2001 | Kerdraon et al. | 89/36.17 |

FOREIGN PATENT DOCUMENTS

GB 2234334 * 1/1991

* cited by examiner

*Primary Examiner* — Stephen M Johnson
(74) *Attorney, Agent, or Firm* — Felix L. Fischer

(57) ABSTRACT

An explosive round countermeasure system incorporates a plurality of linear shaped charges with standoffs for holding the linear shaped charges in parallel spaced relation distal from the structure to be protected, each shaped charge creating a substantially planar jet when detonated. Means for sensing an incoming explosive round having a nose mounted fuse structure is provided and means for detonating at least one of the charges in the array responsive to the sensing means such that the detonation is timed for placement of the fuse structure adjacent the at least one charge.

9 Claims, 24 Drawing Sheets

EXPLOSIVE ROUND COUNTERMEASURE SYSTEM

REFERENCE TO RELATED APPLICATIONS

This application is a divisional application of Ser. No. 12/913,698 filed on Oct. 27, 2010, now U.S. Pat. No. 8,051,762, which is in turn a divisional application of Ser. No. 10/526,602 filed on Mar. 9, 2005, now U.S. Pat. No. 7,827,900 and claims the priority of provisional application Ser. No. 60/618,373 filed on Oct. 7, 2004 all having the same title as the present application.

BACKGROUND OF THE INVENTION

1. Field of the Invention

This invention relates generally to the field of active vehicle protection systems and, more particularly, to a sensor controlled automatically deploying inflatable ballistic penetration resistant airbag system for protection of lightly armored vehicles against rocket propelled grenades (RPG) and other explosive rounds by active defusing to preclude detonation. Additional protection from small arms rounds is also provided by certain embodiments.

2. Description of the Related Art

Various armor systems are employed for protection of personnel and vehicles from small alms fire and shrapnel from anti-personnel mines or grenades. For both individuals and vehicles, the weight and other impediments of the armor dictate the type of armor used.

Fabric armor for self-protection and vehicular protection systems is employed on a regular basis since the development of products such as Kevlar® or other aramid fibers which provide highly resilient protection against ballistic projectiles. Vests, brief cases and similar personal protection items employ Kevlar® or comparable fabrics for light weight highly penetration resistant systems. Seats and vehicular body panels employ similar high strength woven fiber products in lightweight laminates for protection against ballistic penetration.

Recently, the concept of deployable shields using airbag technology to erect a temporary barrier for protection of speaker's podiums, windows, doorways and similar environments from small arms fire has been disclosed in U.S. Pat. Nos. 6,412,391 entitled Reactive personnel protection system and method issued Jul. 2, 2002 and 6,029,558 also entitled Reactive personnel protection system, both assigned to Southwest Research Institute. These systems employ airbag technology to erect a temporary shield, against ballistic projectiles from small arms fire or bomb detonation.

It has become apparent that in addition to small arms fire, rocket propelled grenades (RPG) are a major threat to lightly armored vehicles. It is therefore desirable to employ deployable armor to intercept an RPG as well as protect against small arms fire.

Explosive armor is well known as a countermeasure against both kinetic enemy rounds and explosively formed jets (EFJ's). Explosive armor of prior art may be too heavy to add to light armored vehicles and may expose dismounted troops to unnecessary risk. Hard armor sufficiently thick to absorb the explosively formed jet from an RPG is too heavy for light armored vehicles and may result in a sufficiently high weight to preclude air transport and the rapid deployment which may only be accomplished by air transport. Even the M1 Abrams tank may be demobilized by a RPG depending on point of impact. Chain link fence has been used with partial success against RPG's since the Vietnam Conflict. Direct impact of the piezo-electric fuse against a wire element of a chain link fence can be expected to cause function of the RPG in accordance with its design, i.e., detonation of the shaped charge and formation of the explosively formed jet. Such a jet may penetrate metal several meters distant and may be lethal at a distance of tens of meters. Various attempts have been made to use nets to catch or damage RPG's. A net sufficiently robust to crush the ogive portion of RPG's may be also be sufficiently stiff to cause detonation in the case the fuse directly impacts a net cord element. Such a robust net may also trap without farther damage a piezo-electrically disabled RPG causing time delayed detonation immediately adjacent to the protected vehicle. At the time of this writing "bar armor" is being used by Coalition Forces in Iraq and Afghanistan with partial success against RPG's. Like chain link fence, bar armor can disable the piezo-electric fuse circuit by crushing the ogive as the RPG passes between bars. In the case of direct fuse impact against an individual bar, however, the RPG is likely to function with lethal as-designed EFJ formation. The bar armor may be somewhat better than chain link fence with respect to impact destruction of time delay fuse/high explosive remains of a piezo-electrically disabled RPG. Bar armor effectiveness against RPG's is estimated at 60%. Due to wide variation of azimuth angle and minimal variation in elevation angle of incoming RPG's, bar armor is typically constructed with horizontal bars. Horizontal bars result in a lower chance of direct piezo-fuse impact with a bar compared to vertical bars in the case of azimuth angles less than 90 degrees It is desirable to deploy an armor system that will disable the RPG fusing mechanism to prevent detonation.

It is also desirable to absorb the impact of the RPG on the target vehicle after disabling the fusing mechanism.

It is further desirable to provide in certain applications a "soft catch" of an RPG launched against a vehicle to further avoid detonation and absorb kinetic energy of the round thereby reducing the potential damage to the vehicle and injury to personnel.

SUMMARY OF THE INVENTION

A Rocket Propelled Grenade (RPG) defense system according to the present invention includes a sensing screen and an explosive array or defusing net supported in spaced relation from the structure to be protected for collapsing the ogive of an incoming RPG to disable the fusing mechanism. In enhanced embodiments, an airbag armor system is incorporated into the present invention which includes an airbag system having erection columns inflatable within a ballistic penetration resistant envelope. A barrier screen erected in front of the envelope during inflation incorporates the sensing and explosive elements to disable a RPG fusing system by shorting the ogive nose of the round. The columns are sized to provide energy absorption capability for a catch of the RPG or high G deceleration of the round for inerting of secondary fusing. The airbag system is mounted to a support structure such as the roof, window bow or bottom frame of a vehicle for creating a protection area encompassing a door, side or rear of the vehicle. A gas generator is provided for inflation of the erection columns upon receipt of an ignition signal. A sensor system is employed to detect the motion of a projectile and a processing and control system is operably connected to the sensor system and the gas generator for processing signals from the sensor and igniting the gas generator. The control and processing system processes the sensor signal to assess the detected projectile motion to confirm a profile consistent with a RPG. The processor issues the ignition signal upon a positive prediction.

BRIEF DESCRIPTION OF THE DRAWINGS

These and other features and advantages of the present invention will be better understood by reference to the following detailed description when considered in connection with the accompanying drawings wherein.

DETAILED DESCRIPTION OF THE INVENTION

Figure 1A:
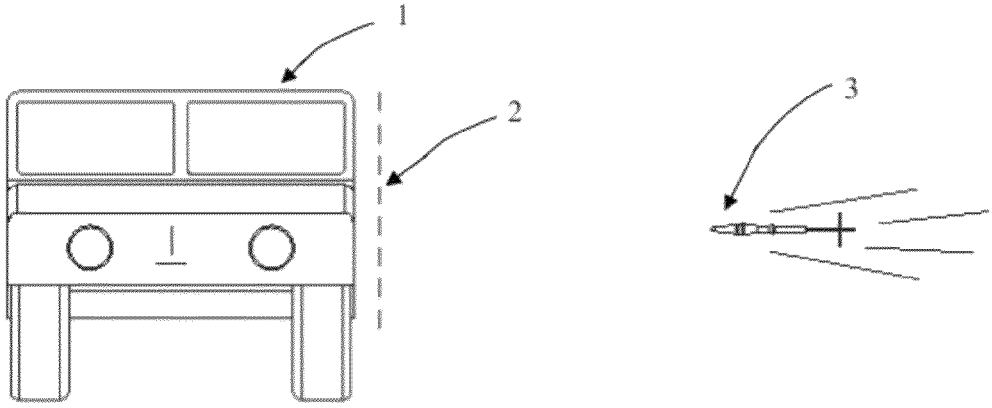
FIGS. 1A, through 1D depict the sequence of function of one embodiment of the present invention.
Figure 1B:
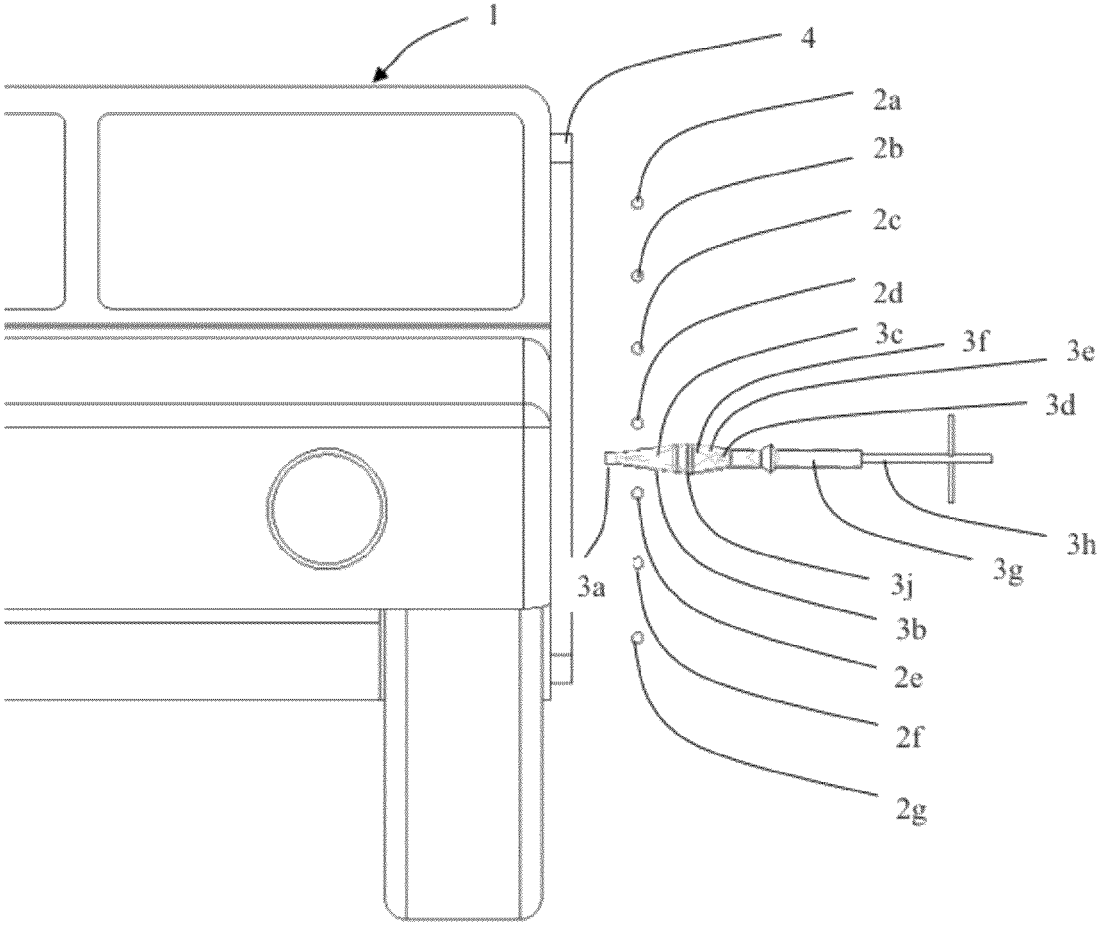

A countermeasure system which is capable of defusing rocket propelled grenades such as the PG-7M is provided by the present invention. Exact performance and properties vary based on the age of the unit, however as exemplary data, the PG-7M is launched at a velocity of approx. 100 meters per second. A recoilless launch burst charge carries the RPG a distance of approximately 25 meters after which the rocket engine begins to accelerate the round to a velocity of about 300 meters per second. The PG-7M and similar RPG's may detonate by three distinct means as follows:

1) The piezo-electric fuse nose of the RPG may contact the target causing it to be compressed and to generate a Voltage. The electrical circuit to the detonator is comprised of a circuit through the inner and outer ogives of the rocket nose cone. As the generated Voltage reaches approximately 1000 Volts, a spark discharge occurs within the detonator. Detonation in this case causes a shaped charge to explode which in turn causes an explosively formed jet to form. The explosively formed jet ("EFJ") may penetrate approximately 14 inches of steel armor.

2) In case the piezo-electric fuse is not actuated within approx. 4.5 seconds after launch, a time delay pyro-fuse causes detonation and probable EFJ formation.

3) In case of high speed impact against a hard target such as steel armor plate, shock initiated detonation may occur. Such detonation may follow malformation of the copper cone and the likely initiation point is nearest the leading edge of the high explosive. Formation of an EFJ is thus highly unlikely; however local explosion damage and shrapnel production is likely.

The various embodiments of the present invention reliably prevents all three of the aforementioned detonation mechanisms. In a first embodiment, defusing net or detonation net formed with primacord is preferably spaced 5 inches or more away from the protected vehicle in order for the nose of the RPG to pass through the net, placing the countermeasure susceptible ogive in the plane of the net before the piezo-electric fuse is activated by impact with the protected vehicle. In order to prevent piezo-electric fuse function, the outer ogive is explosively crushed by the primacord against the inner ogive creating a short circuit. Under some circumstances, the fuse may be entirely sheared off of the RPG. Crushing and shearing of the ogives may be by means of a net or grid of primacord (aka cordex).

In order to prevent a time delay detonation, the RPG is decelerated upon impact with sufficient force to cause flattening of the copper cone, dispersal of the high explosive and probable impact damage to the detonator.

In order to prevent shock initiated impact detonation of the high explosive within the RPG, a compliant impact surface is provided in advanced embodiments. Such a surface in alternative embodiments is a rubber mat, Aramid fabric blanket, wood, foam, or the like and, in some embodiments incorporates inflatable or gas filled voids or chambers.

It should be understood that discrete explosive charges other than primacord forming an array or matrix are used for the defusing net in alternative embodiments of this invention. For example, an array of encapsulated point charges arranged in an array might be used instead of lines or grids of primacord. Alternatively, short lengths of primacord are arranged in an orientation parallel to the anticipated flight path. In advanced embodiments, the ends of the primacord facing the threat include flexible whiskers extending therefrom for the purpose of deflecting primacord elements away from the fuse of an incoming RPG, thereby minimizing the possibility that impact of the fuse against the primacord element might cause an RPG to detonate.

It is further desirable that the remains of the post-impact RPG bounce off of or be deflected away from the protected vehicle. To this end it is preferable that the various parts of the protective system be configured to neither catch nor trap the remnants of the RPG. The system of this invention may be configured to, either automatically or under manual control, detonate any lengths of primacord from which portions of the post-impact RPG may be suspended. In this manner damage from any explosion which might be caused by a time delay fuse not destroyed during impact may be minimized.

It is advantageous from a safety standpoint that dismounted troops not be in direct contact with or in very close proximity to primacord or other explosives during detonation. It is therefore a further object of an embodiment of this invention to provide for an automatic arm/disarm function on the basis of automatic RPG launch detection means such as radar, hyper-temporal spectrographic sensing, infrared sensing, or acoustic sensing for example.

A further aspect of one embodiment of this invention is the provision of a break screen, the elements of which may be individually and automatically checked for continuity prior to arming the system. In this manner, prior bullet damage to any individual break screen elements will not cause immediate and untimely detonation of any primacord elements upon system arming. In accordance with a further aspect of the aforementioned embodiment, the time delay between break screen element breakage and primacord detonation may be adjusted in accordance with the most probable ogive penetration depth between primacord. The sensing function of the break screen is also accomplished in alternative embodiments using touch sensor technologies. Exemplary touch sensor technologies are represented in the patents and publications disclosed in Appendix A, each of which is incorporated by reference as thought set forth fully herein.

The concept of positioning explosives such as primacord on the threat side of the target to be protected at a distance sufficient to allow passage of the nose fuse past the explosive may be used in conjunction with a variety of threat detection and tracking means. For example, in accordance with a further aspect of one embodiment of this invention, a proximity detection circuit similar to touch detection systems or proximity fuses may be used to detect the presence, location and velocity of an RPG as it approaches and enters the detonation net or other arrangement of explosives. Such an arrangement might be more resistant to bullet, debris, or wind damage than a system based on a grid of wires on a 1 cm spacing, for example. Alternatively, an optical break screen might be used to determine the speed and position of an incoming RPG, which information could be used to automatically select the appropriate zones of primacord to detonate.

In certain embodiments of the invention, small explosive charges are launched a short distance, 6 to 12 inches for example, from the protected target at which point they would detonate. Such explosive charges are in the form of primacord or discrete charges in various embodiments. Detonation is accomplished by means of a tether of fixed length or by means of time delay elements. Such systems would be distinct from the launched explosive systems of prior art in so far as the associated defensive explosive charges would be timed and sized to primarily damage the RPG ogive. Such systems would produce far less collateral damage than systems of prior art which rely on massive explosions and shrapnel generation. Such an embodiment would permit the explosive charges to be attached directly to the target to be protected, thus lessening the possibility of damage to system elements prior to use. Such an embodiment may also be suitable for protection of aircraft, which might not be able to be protected by a detonation net supported by stand-offs because of wind damage and drag considerations.

In accordance with a further embodiment of this invention, explosive charges such as lengths of primacord as well as break screen elements are fixed to an inflatable structure of sufficient compliance as to not pose a piezo fuse activation risk during an RPG penetration of said inflatable structure. Sufficient compliance for safe puncture by fuse may be achieved by any appropriate combination of low density, low modulus and low tear strength. The shape of the inflatable is generally mattress like with internal ties or multiple chambers designed to provide generally shield like proportions.

In accordance with a further aspect of the aforementioned embodiment of this invention, inflation is initiated by means of radar or other sensor based threat detection in conjunction with automotive air bag (passenger restraint) type gas initiators. In this manner, the inflatable structure is kept secure from battle or other damage until a threatening RPG has been launched.

The inflatable structure further employs CO2 thr inflation in certain embodiments to enhance the fire protection capability of the system.

In yet other embodiments of the invention, an inflatable structure is actuated in response to an RPG threat, wherein the inflatable structure serves to support the detonation net on stand-offs. In such a configuration the inflatable structure would not be intended to allow safe penetration of an RPG fuse, but is in fact designed to provide small arms and fragmentation protection to the protected vehicle. Such a configuration is automatically inflated in response to a detected threat or manually actuated in accordance with circumstances.

In further embodiments of the present invention, inflatable deployment devices as previously described are attached to the outsides of the doors of a vehicle. In this manner, the deployed inflatable structure is less likely to prevent timely egress by the vehicle occupants. Such a configuration also utilizes in certain embodiments inflation actuated protection of windows or other features of increased damage susceptibility.

In a further embodiment of this invention, an inflatable structure is used to cushion and distribute impact forces and possible explosion forces against a protected target such as a vehicle, while presenting to the defused incoming RPG a sufficiently rigid surface to cause destruction of the time delay fuse and/or its associated explosive assembly. The RPG impact surface is preferably just compliant enough to minimize the probability of a shock initiated detonation. Such a configuration is employed to protect a windshield, for example.

A combination of structures mentioned as embodiments of the invention previously are used to protect a target such as a vehicle. For example, a detonation net and break screen are used to protect wheel areas or air intake louvers which are ill suited for coverage by a compliant mat. Other structural robust areas such as the sides of armored doors are fitted with rubber mats or other impact surfaces sufficiently compliant to help prevent shock initiated detonation, while sensitive areas such as windows, sensors, exposed weapons, or exposed personnel such as a gunner are protected by rapidly inflatable shields. Such shields are configured to hold a detonation net at an optimum stand off distance from the RPG impact surface.

Figure 1C:
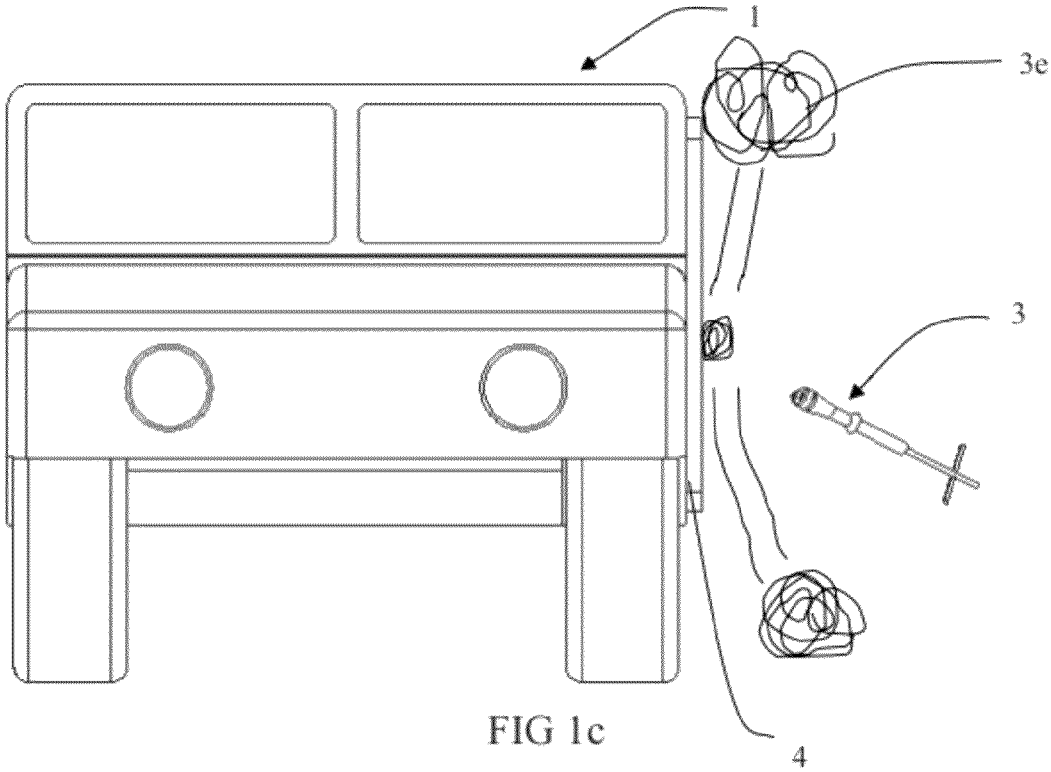
Figure 1D:
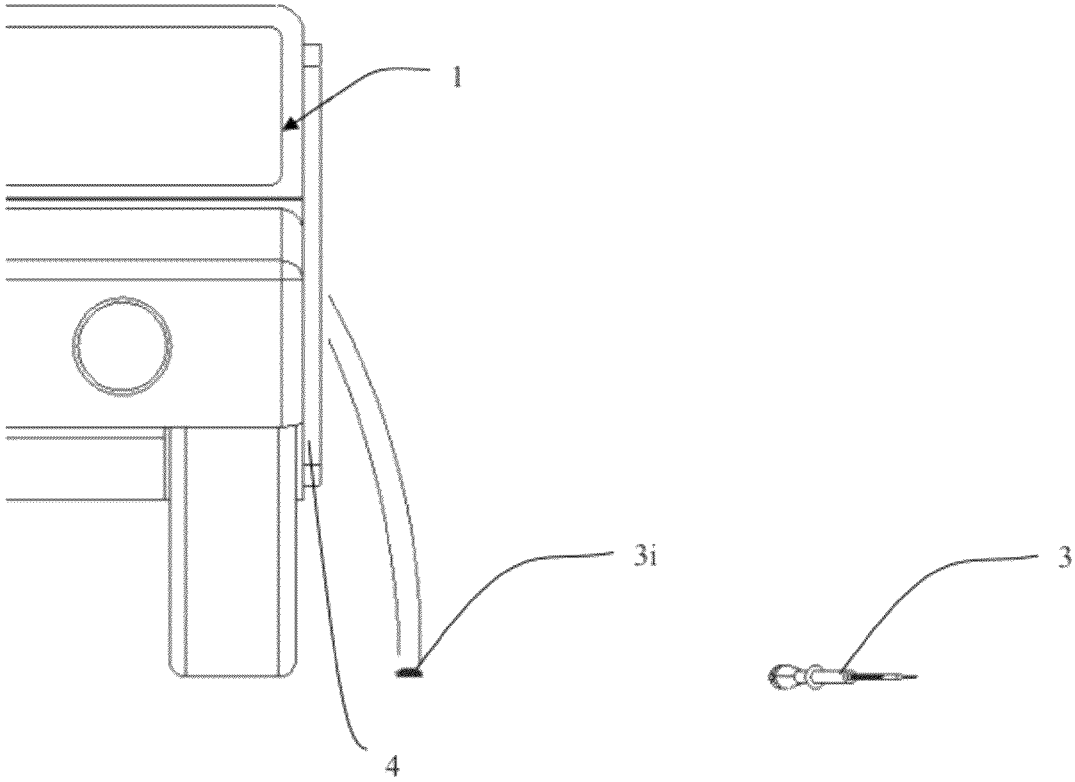

Referring to FIGS. 1A through 1D, vehicle 1 is equipped with explosive net 2 comprised of individual explosive elements 2*a*, 2*b*, 2*c*, 2*d*, 2*e*, 2*f*, 2*g*, and 2 *h* which protect vehicle 1 from RPG 3. RPG 3 incorporates piezoelectric fuse 3*a* which generates a Voltage upon impact. Ogive (nose cone) 3*b* serves as an electrical conductor for current which flows through housing 3*j* then through detonator fuse portion 3*d* then through shaped charge liner 3*f*, then inner cone 3*c* completing a circuit back to piezoelectric fuse 3*a*. As previously described, the present invention is employed to short out or break the aforementioned electrical circuit in order to prevent electrical detonation of the high explosive 3*e*. Shorting of the electrical circuit is by means of crushing Ogive 3*b* onto inner cone 3*c* by means of explosive overpressure. Shorting is alternatively accomplished by explosive penetration of Ogive 3*b* followed by intrusion of ionized and electrically conductive explosive by-products into the space between Ogive 3*b* and inner cone 3*c*. Breaking of the electrical circuit is also alternatively accomplished by explosively shearing off Ogive 3*b* and/or inner cone 3*c*. A shock absorbing impact surface 4 of crushable or elastomeric material is provided in certain embodiments to reduce the possibility of impact initiated detonation of high explosive 3*e*. FIG. 1*c* depicts the dispersal of high explosive 3*e* upon impact. FIG. 1*d* depicts the flattened and destroyed warhead portion 3*i* of RPG 3 after impact.

Figure 2:
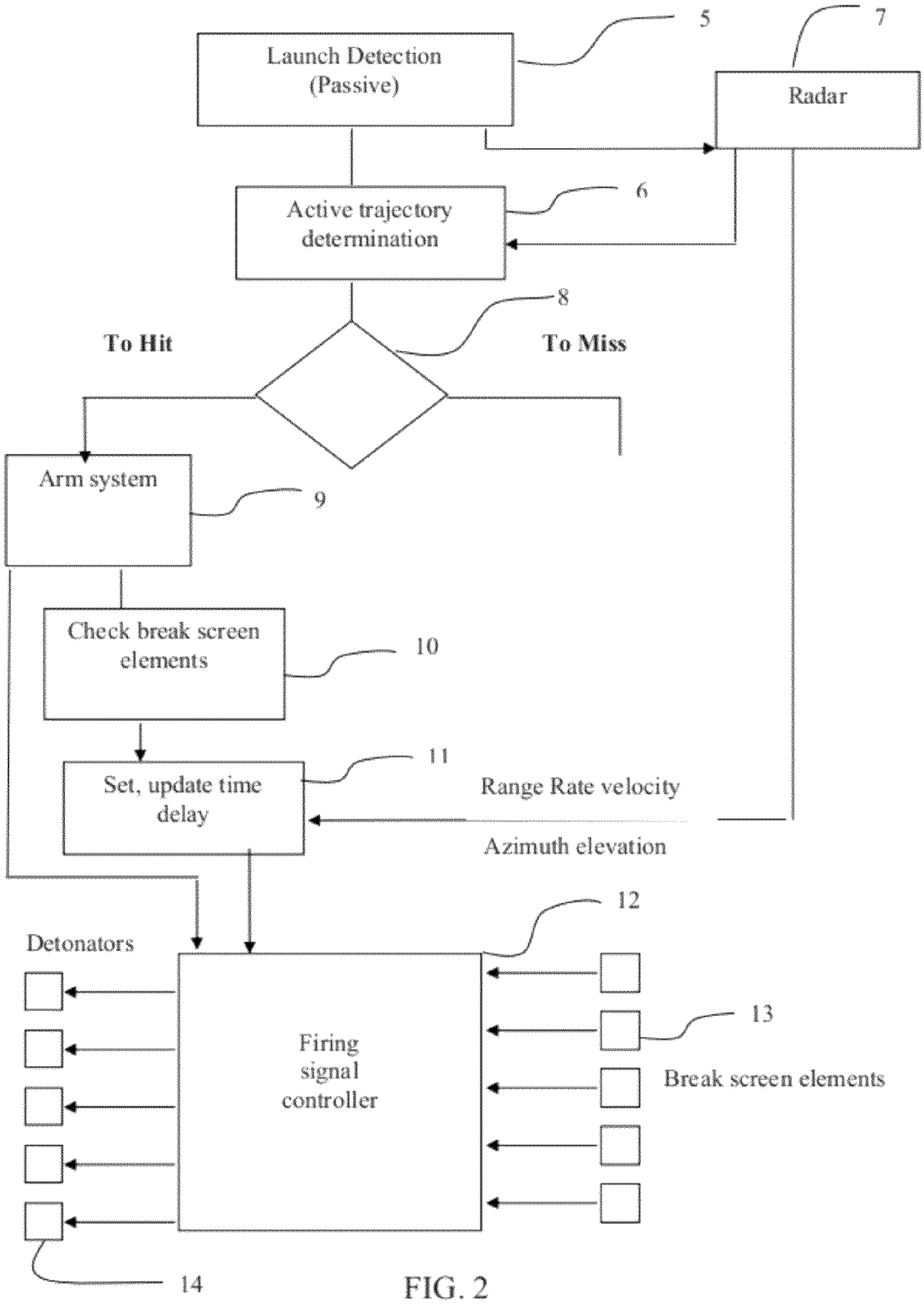
FIG. 2 is a control schematic of an embodiment of the present invention.
Figure 3C:
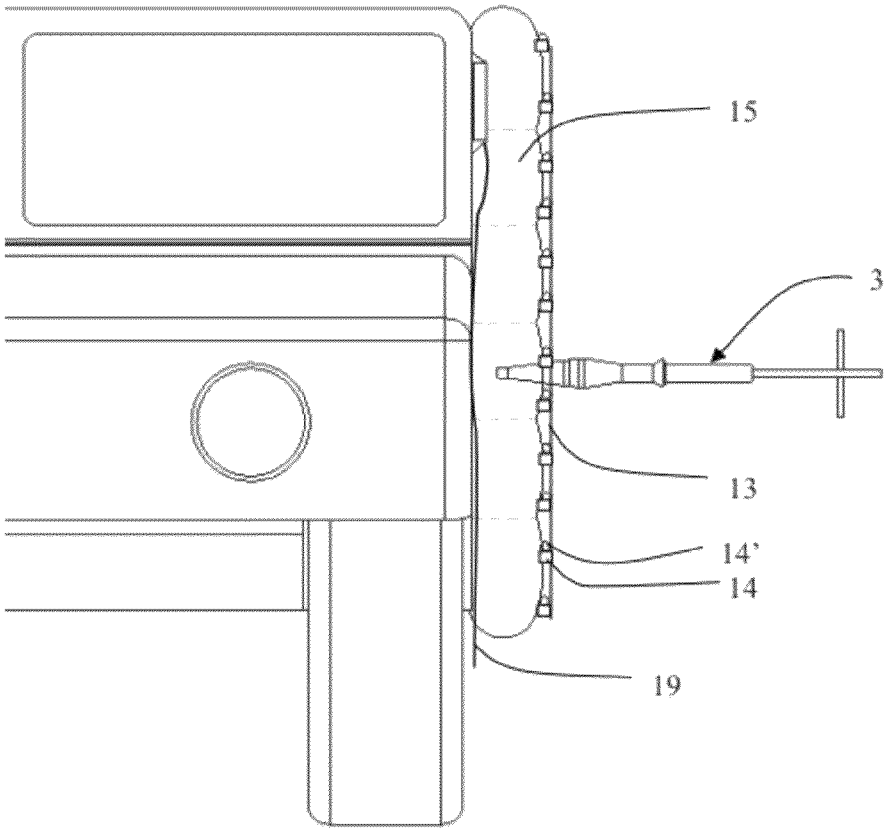
FIGS. 3*a*, 3*b* and 3*c* depict the sequence of function of another embodiment of the present invention.
Figure 3A:
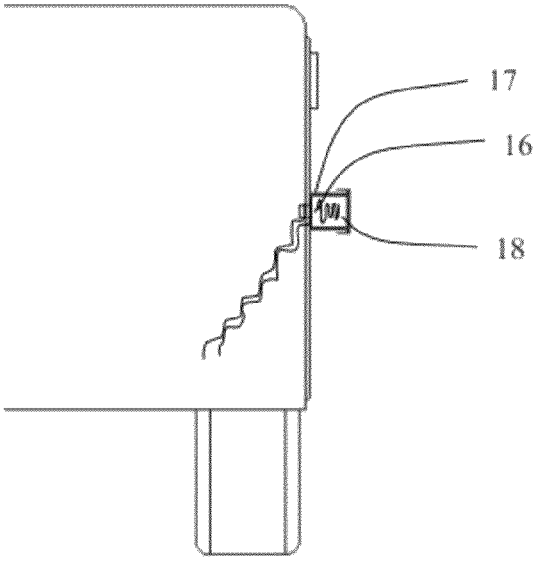
Figure 3B:
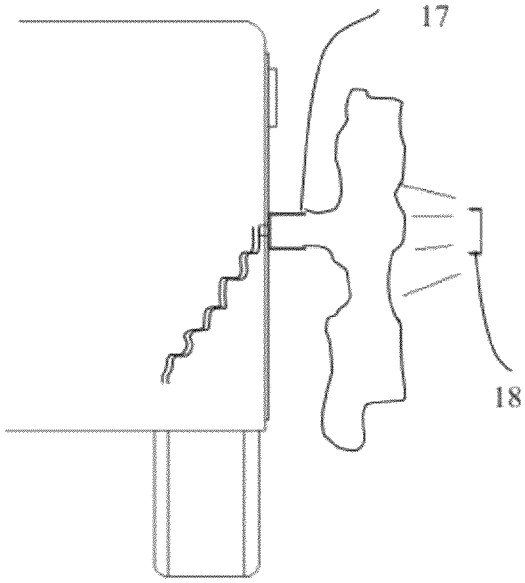

Referring to FIG. 2, launch detector 5, which in various embodiment is an infrared, acoustic, or radio frequency sensor, for example, is used to turn on radar 7. Radar 7 is used by trajectory computer 6 to determine velocity of threat and probable point of impact. Discriminator 8 selects which, if any, sub-systems 9 are to be armed. Upon arming of subsystem 9, for example, break screen elements 13 are each checked for continuity on that premature detonation of detonators 14 does not occur in response to prior small arms fire damage, for example. Referring to FIGS. 3*a* through 3*c* as well, in the case of an inflatable deployment system, arming the system includes inflation of a spacer 15 by means of initiator 16. Either all of, some of or one of detonators 14 and associated charges 14' are initiated in response to breakage of break screen elements 13 according to design optimization, types of threats and the relative desirability of disposing of any remains of inflatable structure 15. The inflatable structure 15 is housed in enclosure 17 and protected by cover 18, by way of example. Fire resistant barrier 19 is employed in certain embodiments and simultaneously deployed in order to minimize ingress of explosive through vehicle openings at doors and windows, for example. CO2 is further employed in certain embodiments as the inflating gas for the spacer bag further enhancing the fire protection capability of the system.

Figure 4:
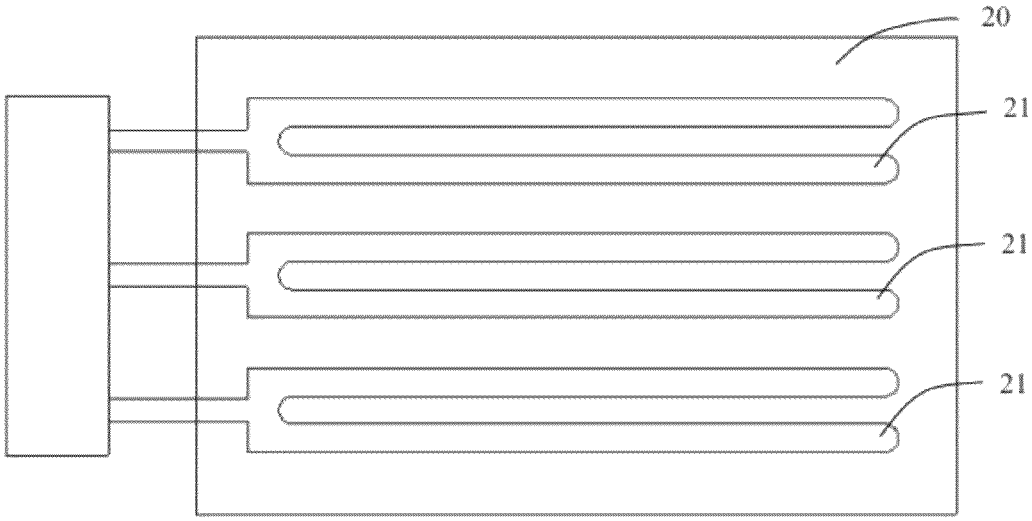
FIG. 4 illustrates a plurality of break screen circuits attached to a supporting sheet.

Referring to FIG. 4, a flexible substrate 20 supports break screen elements 21.

Figure 5:
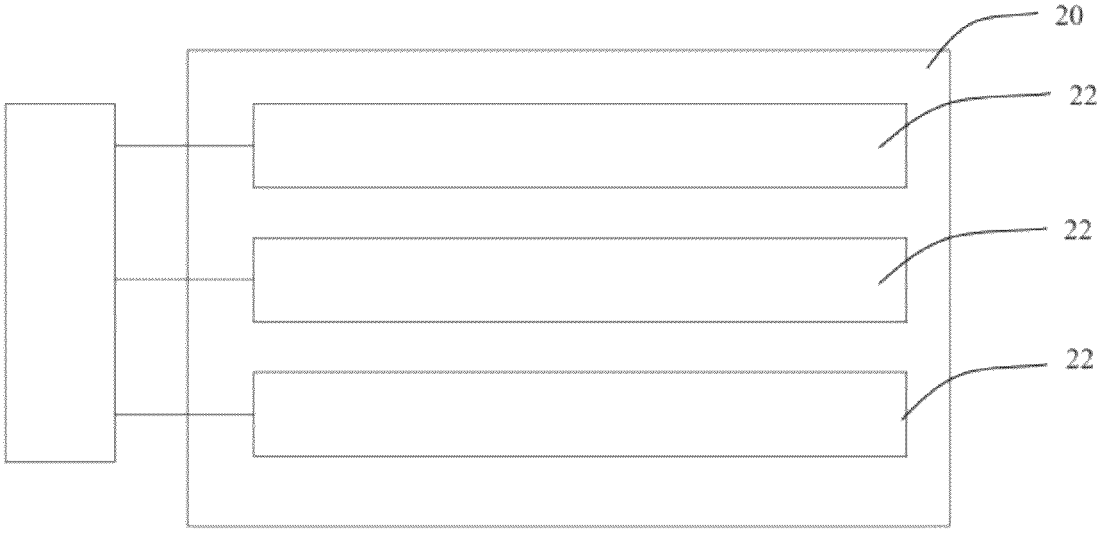
FIG. 5 illustrates a plurality of contact elements attached to a supporting flexible sheet.

Referring to FIG. 5, flexible substrate 20 supports electrical contact regions 22 which are formed in exemplary embodiments by selective metallizing on Mylar film.

Figure 6:
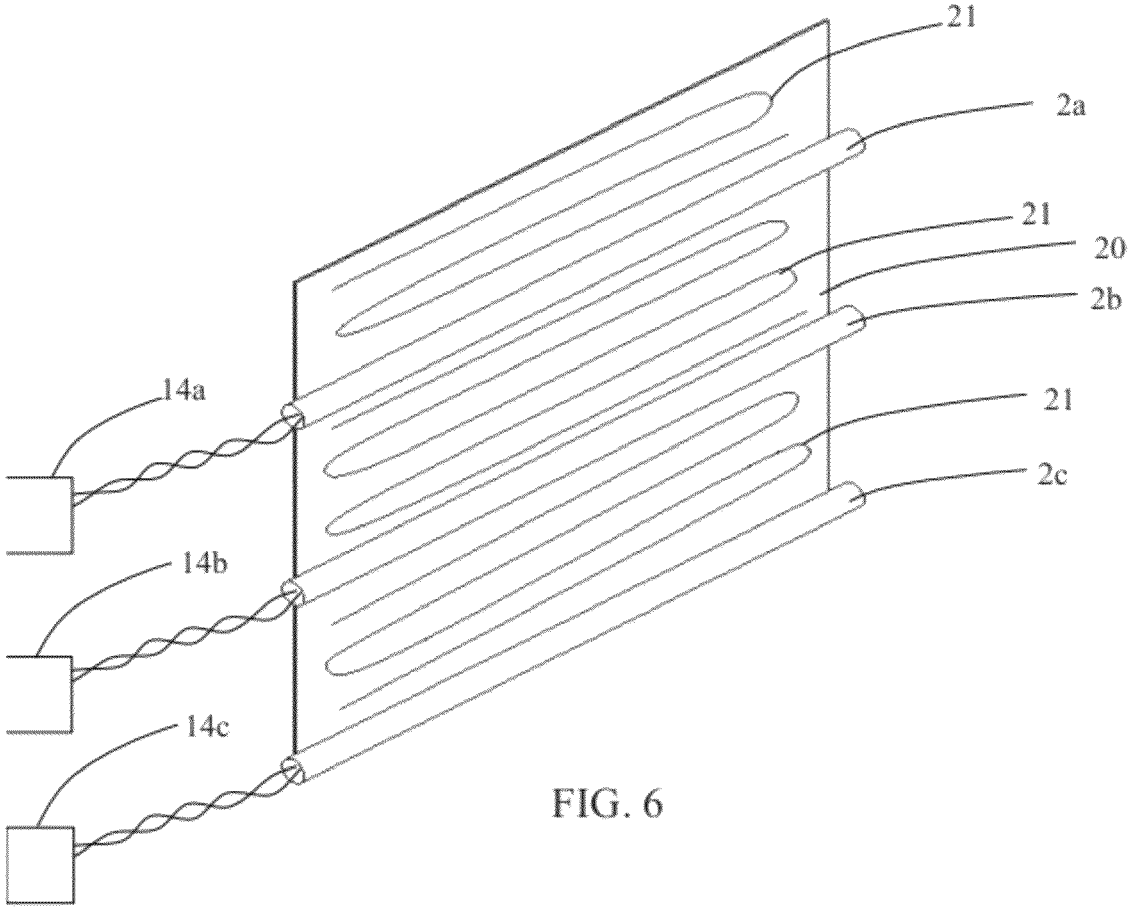
FIG. 6 illustrates multiple explosive elements attached to a supporting flexible sheet.

Referring to FIG. 6, Primacord elements 2*a*, 2*b* and 2*c* are selectively initiated by detonators 14*a*, 14*b*, and 14*c* in accordance with detection by break screen elements 21. With such an arrangement, those primacord elements adjacent to an engaged RPG may be detonated, while leaving other primacord elements in place for use against a future threat. Selective detonation additionally reduces any risk to nearby dismounted friendly troops.

Figure 7:
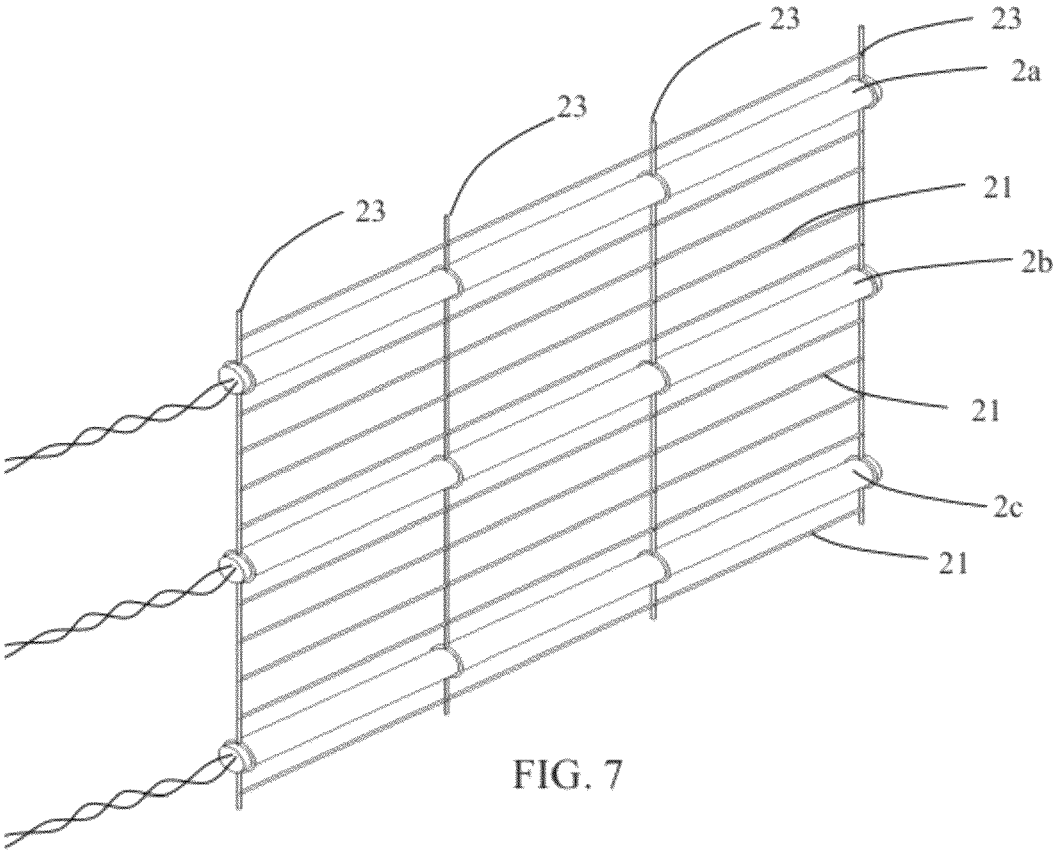
FIG. 7 illustrates a wind pervious screen like assembly comprised of explosive elements, break screen elements, and inert supporting structural elements.

Referring now to FIG. 7, a wind pervious construction is depicted. Explosive elements 2*a*, 2*b* and 2*c* and break screen elements 21 are held in relative position by and supported by spacing elements 23 which for exemplary embodiments are nylon ties. Note that it is desirable that support elements with sufficient rigidity or mass to set off the piezoelectric fuse be avoided or minimized in the configuration of a defense system in accordance with this invention. Accordingly, the structures of the wind pervious net and the membrane construction are comprised of light weight and flexible materials.

Figure 8:
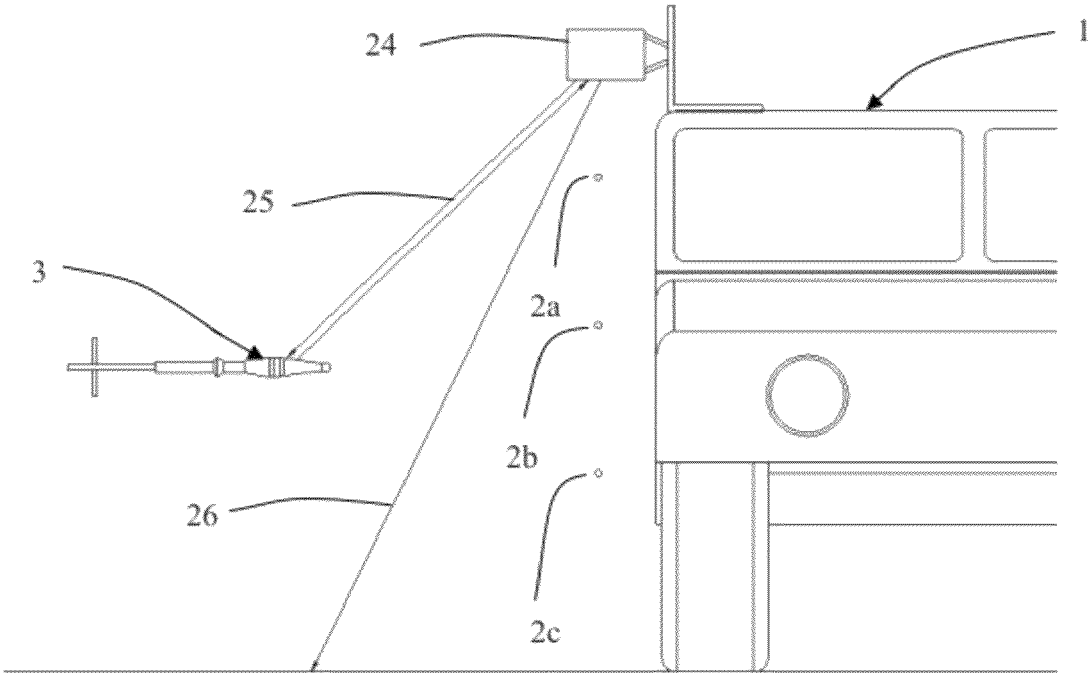
FIG. 8 illustrates a relationship between an optical break screen, explosive elements, and a protected vehicle.

Referring to FIG. 8, an optical break screen is depicted wherein transceiver 24 detects the trajectory of an RPG by means of light paths 25 and 26. Distance measurement from transceiver 24 to RPG 3 is by means of optical time of flight measurement, for example.

Figure 9:
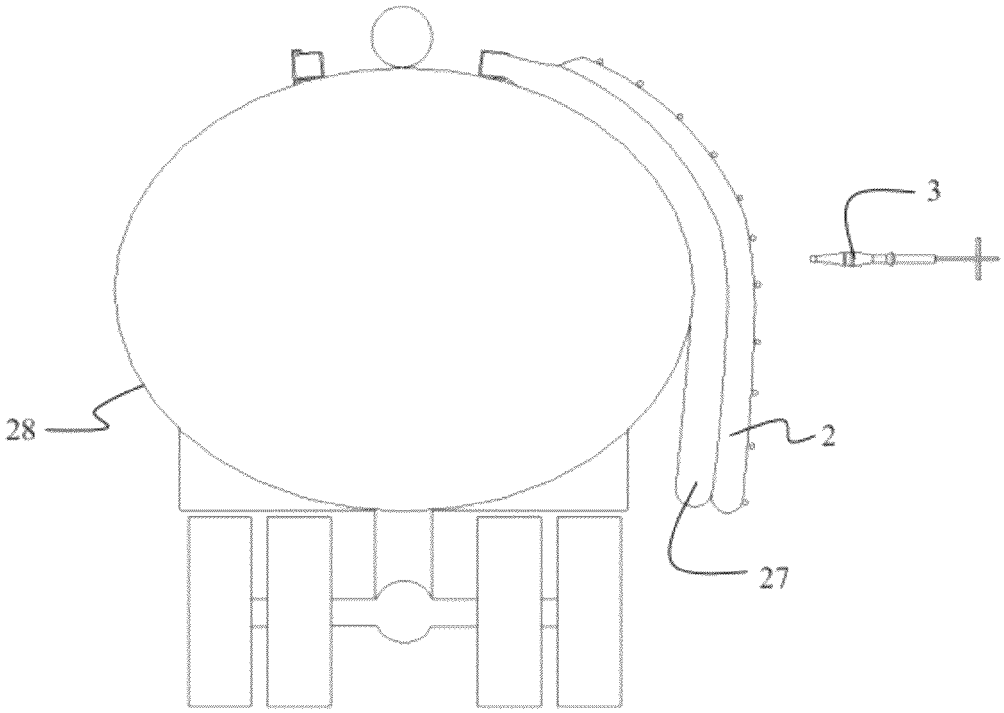
FIG. 9 illustrates an arrangement of inflatable armor and an explosive array in conjunction with a fuel track protected in accordance with one aspect of an embodiment of this invention.

Referring to FIG. 9, RPG 3 is defused by detonation net (net of primacord) 2 supported by a an inflatable standoff as previously described, then caught by inflatable armor assembly 27 which is comprised of layers of high strength materials such as Kevlar or Spectra supported by an inflatable spacer such as conventional automotive passenger restraint air bag construction, as will be described in greater detail subsequently. In this manner an unarmored structure such as a thin gage fuel tank 28 may be protected from RPG penetration.

Figure 10:
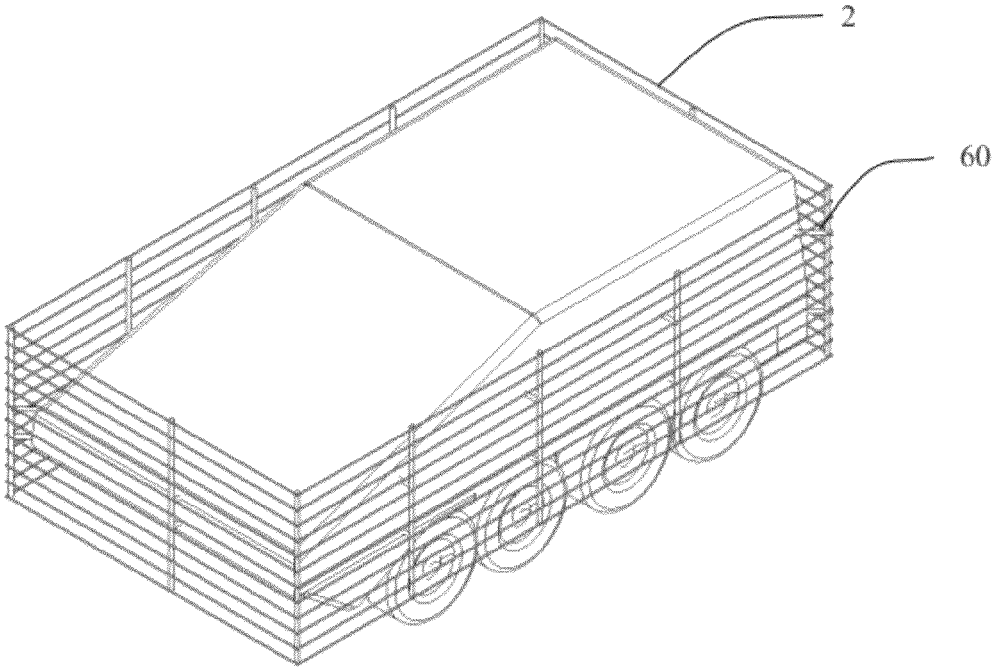
FIG. 10 illustrates an array of explosive elements surrounding a vehicle protected in accordance with one aspect of an embodiment of this invention.

FIG. 10 discloses an exemplary embodiment of the detonation net arrangement with rigid standoffs 60 spacing the net from a vehicle.

Figure 11A:
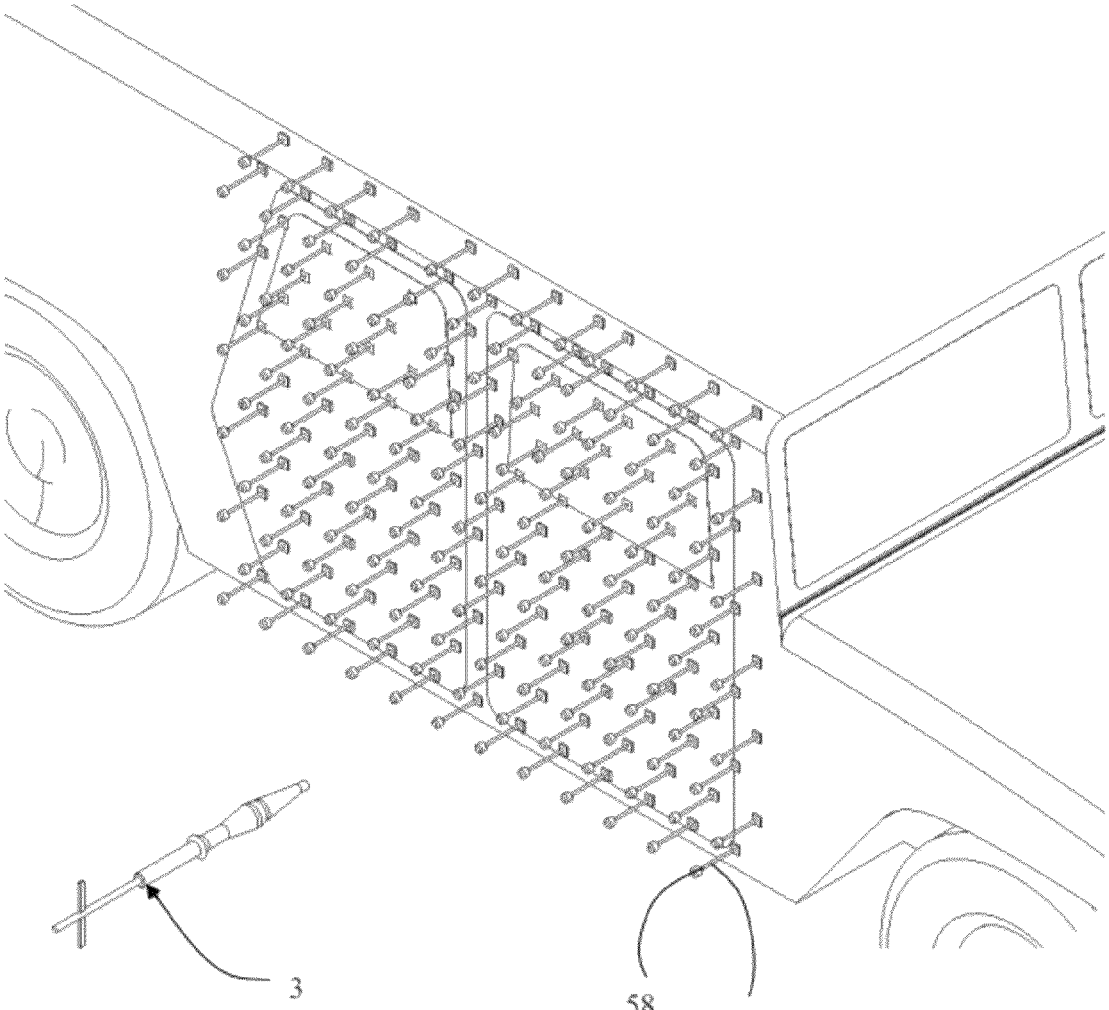
FIG. 11*a* depicts an array of discrete nonlinear explosive charges positioned at a stand off from a protected vehicle.
Figure 11B:
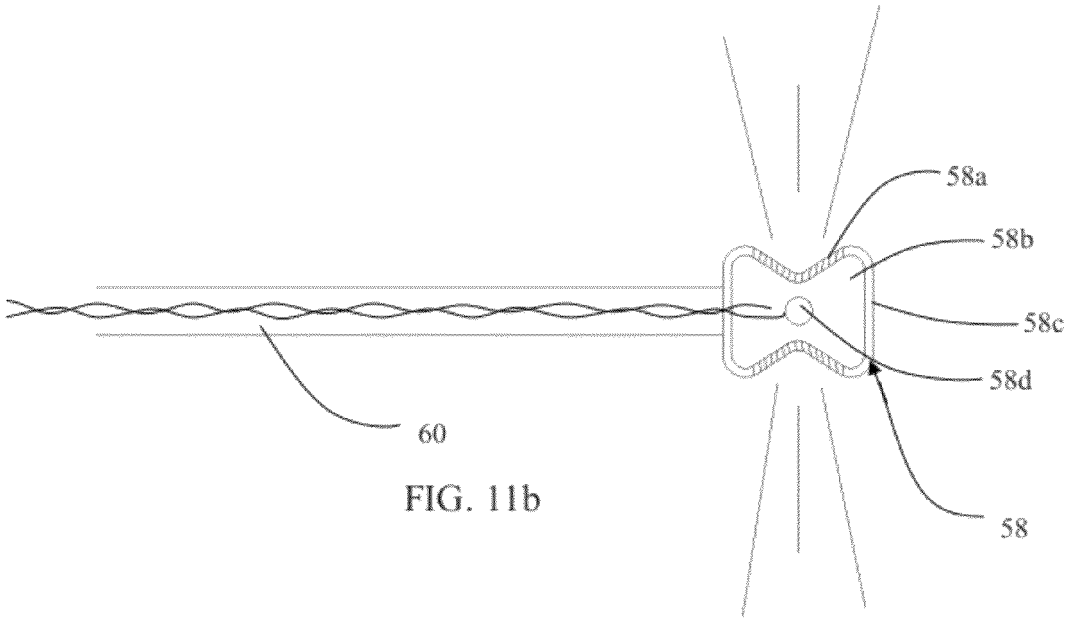
FIG. 11*b* depicts a radial plane shaped charge explosive mounted to a stand off.

Referring to FIG. 11*a*, an array of discrete point charges 58 mounted on standoffs 60 to a vehicle are shown. For some applications, such a configuration as a detonation matrix may be advantageous as opposed to stranded net forming a detonation net of primacord as previously described. The point charges of FIG. 11*a* are preferably generally radially jetting shaped charges in order to maximize the ratio of threat penetrating overpressure to blast effects which might affect the supporting protected vehicle or dismounted friendly troops. Such a radially jetting shaped charge 58 is shown in FIG. 11*b*. Stand-off 60 supports shaped charge 58 which is comprised of axisymmetric components liner 58*a*, casing 58*c*, high explosive 58*b* and detonator 58*d*.

Figure 11C:
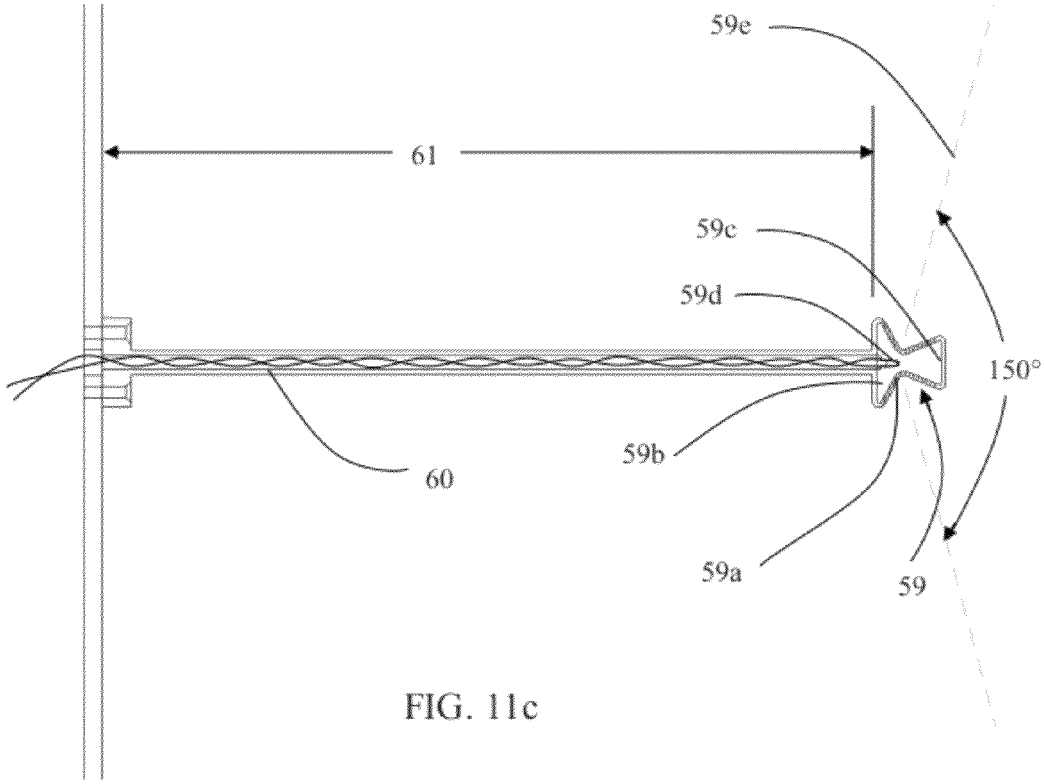
FIG. 11*c* depicts a conical focus shaped charge explosive mounted to a stand off.

Referring to FIG. 11*c*, a shaped charge 59 is shown which is designed to produce a jet of wide angle conical form. With such a jet form, damage or unintended sympathetic detonation of adjacent charges may be minimized. Furthermore, the required stand-off distance 61 from the vehicle required for defeating the fusing circuit prior to fuse impact can be reduced, thus facilitating a more compact and robust form. Shaped charge 59 is comprised of axisymmetric components liner 59*a*, casing 59*c*, high explosive 59*b* and detonator 59*d*. Conical focus path of jet 59*e* minimizes the possibility of unintended sympathetic detonation of adjacent charges.

Figure 12A:
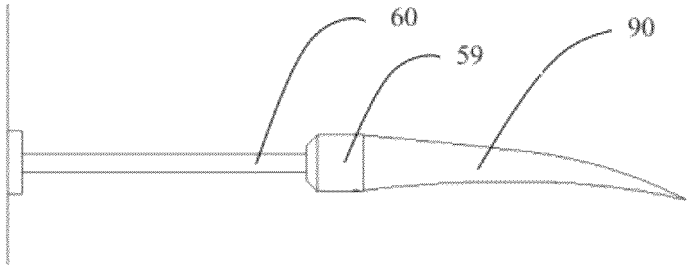
FIG. 12*a* depicts an explosive charge mounted to a stand off and further incorporating a flexible whisker direct impact avoidance means.
Figure 12B:
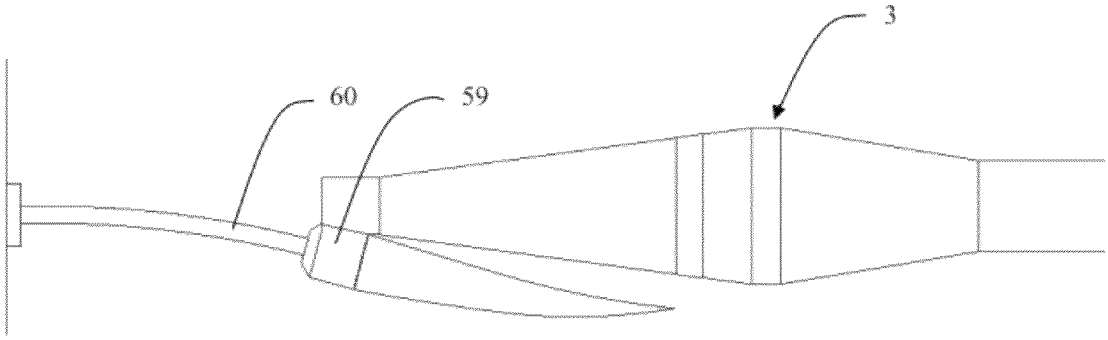
FIG. 12*b* illustrates the intended interaction of an RPG with the explosive charge of FIG. 12 *a;*
Figure 12C:
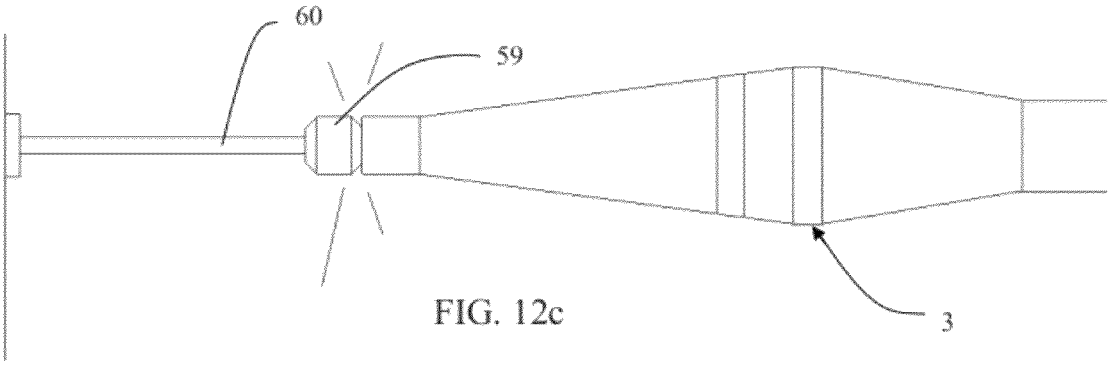
FIG. 12 *c* illustrates the geometry of a direct impact of an RPG with a stand off mounted explosive charge which lacks an impact avoidance whisker.

FIGS. 12*a* and 12*b* demonstrate the use of whiskers 90 mounted to the projected end of shaped charge 59 for deflection of the charge upon a direct hit by the RPG thereby avoiding activation of the fuse. Stand-offs 60 are fabricated from pliable rod whereby contact with the RPG on the whisker deflects the charge to prevent forcible contact sufficient to initiate the fuse. FIG. 12*c* demonstrates the effect of a direct hit without the whisker and pliable mount where impact of the RPG would result in initiation of the fuse prior to defusing by the charge matrix.

Figure 13A:
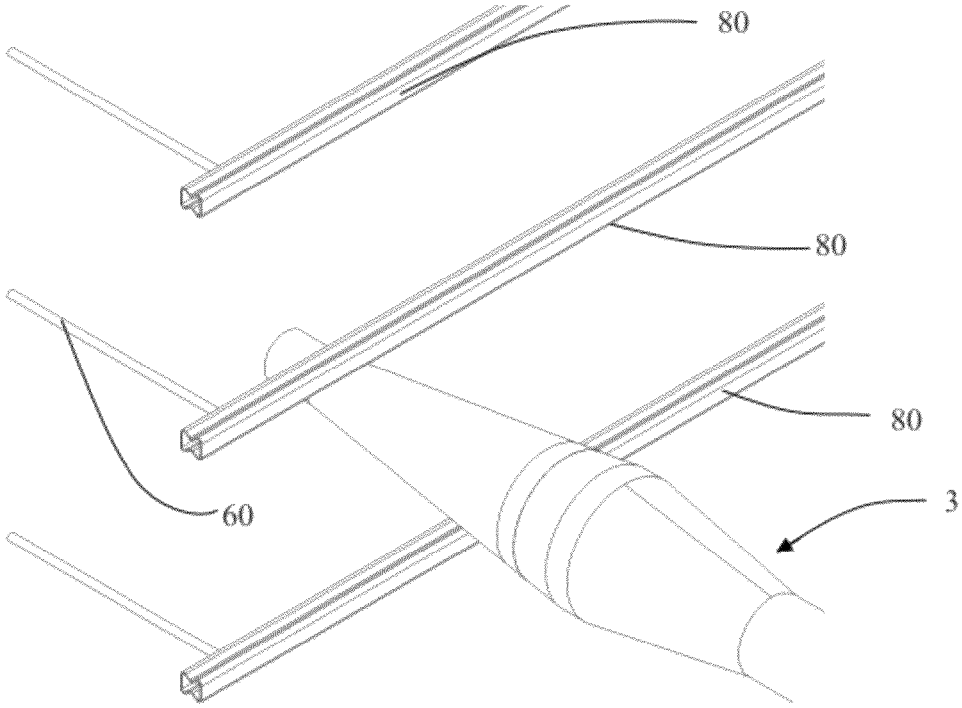
FIG. 13*a* illustrates the relationship between an arrangement of linear symmetric in two planes shaped charges and an incoming RPG.
Figure 13B:
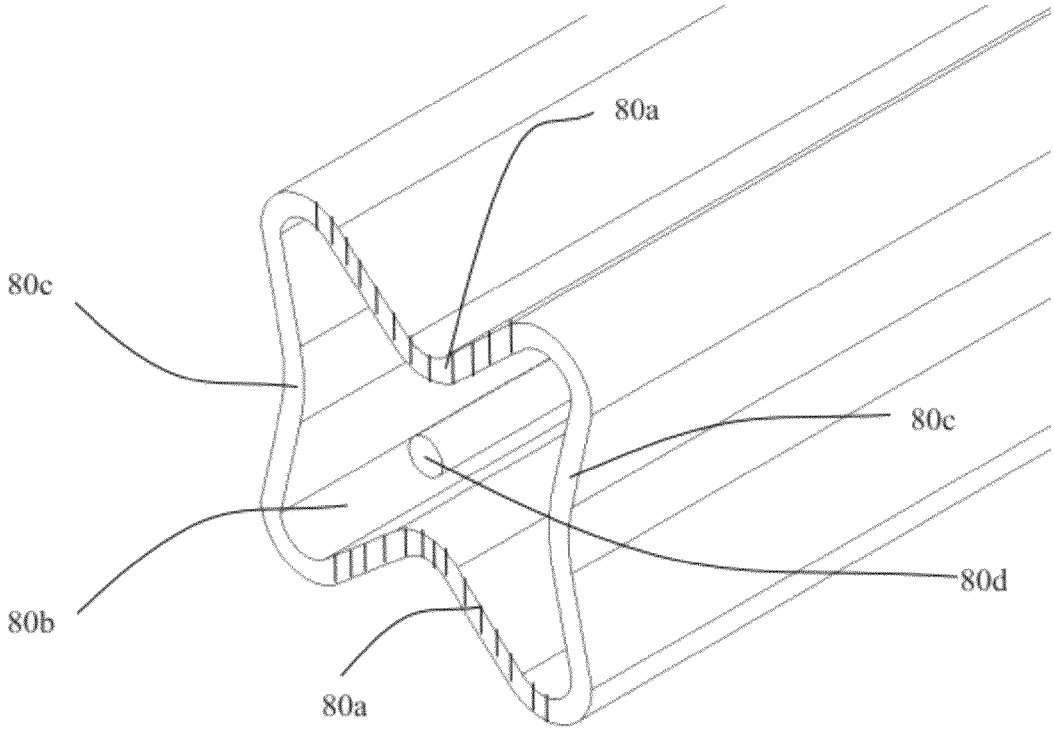
FIG. 13*b* illustrates the relationship between an arrangement of linear symmetric in one plane shaped charges and in incoming RPG.

Referring to FIGS. 13*a* and 13*b*, an array of bi-directional linear shaped charges 80 is shown. Each linear shaped charge is comprised of liners 80*a*, casing 80*c*, high explosive 80*b* and detonator 80*d*. The use of linear shaped charges instead of primacord is employed in alternate embodiments for defeat of hardened. RPG rounds or the defeat of more robust threats such as anti-tank guided missiles (ATGMs).

Figure 13C:
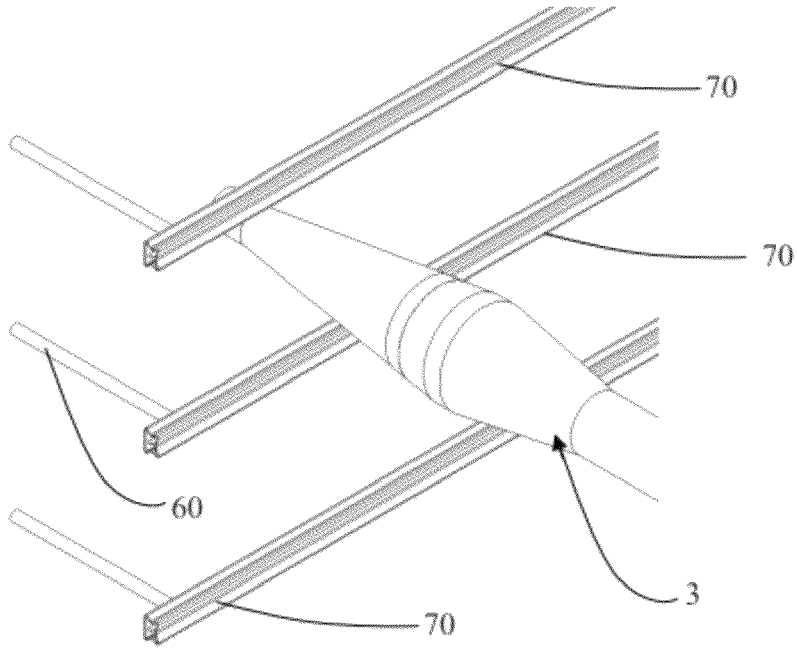
FIG. 13*c* illustrates an alternative embodiment of the linear shaped charges of in an array.
Figure 13D:
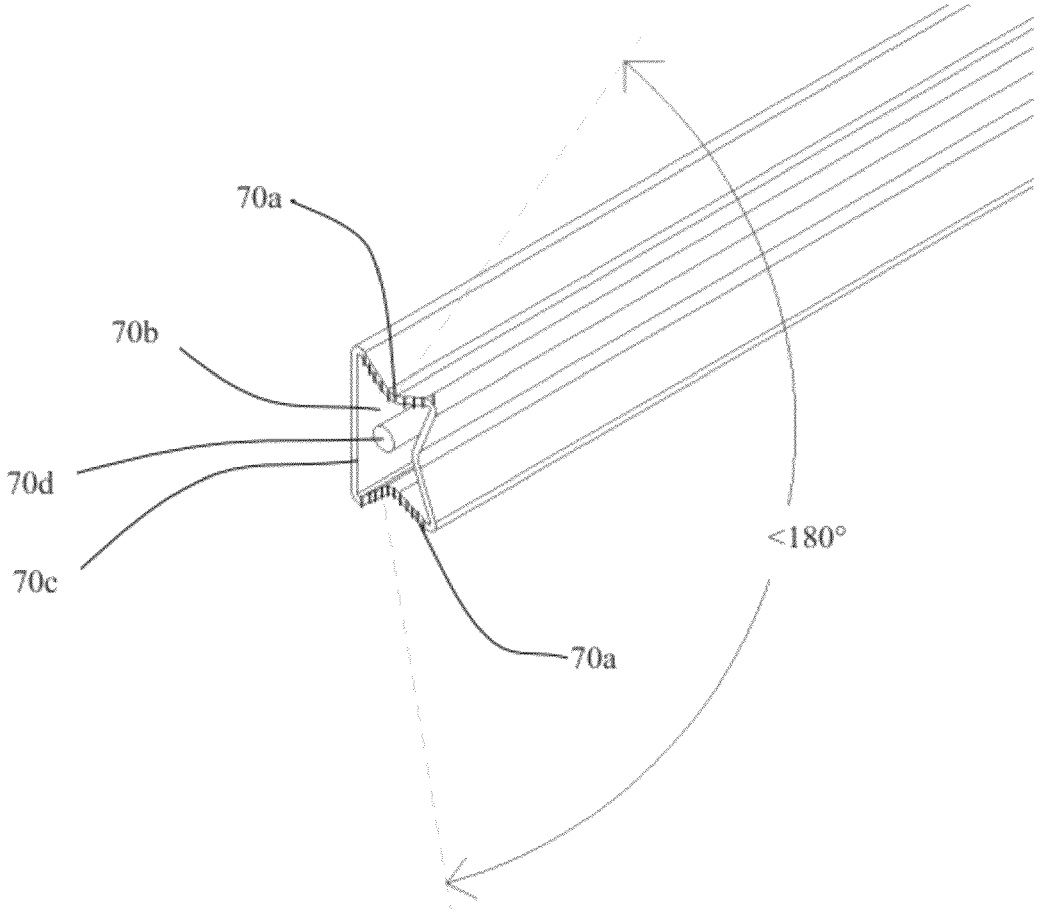
FIG. 13*d* illustrates an arrangement of the shaped charges of FIG. 13*c* to provide planes of the emitted jet at less than 180°.

Referring to FIGS. 13*c* and 13*d*, an asymmetric bi-directional linear shaped charge 70 is shown comprised of liners 70*a*, casing 70*c*, high explosive 70*b*, and detonator 70*d*. Shaped charge 70 is designed to produce opposing jet paths which are less than 180° apart in order to avoid unintended sympathetic detonation of adjacent linear shaped charges and to reduce jet damage to the protected vehicle of structure. A shortening of the required stand-offs is permitted with this arrangement based on the jet direction impacting the incoming RPG at a distance beyond the plane of the detonation array or matrix.

Figure 14:
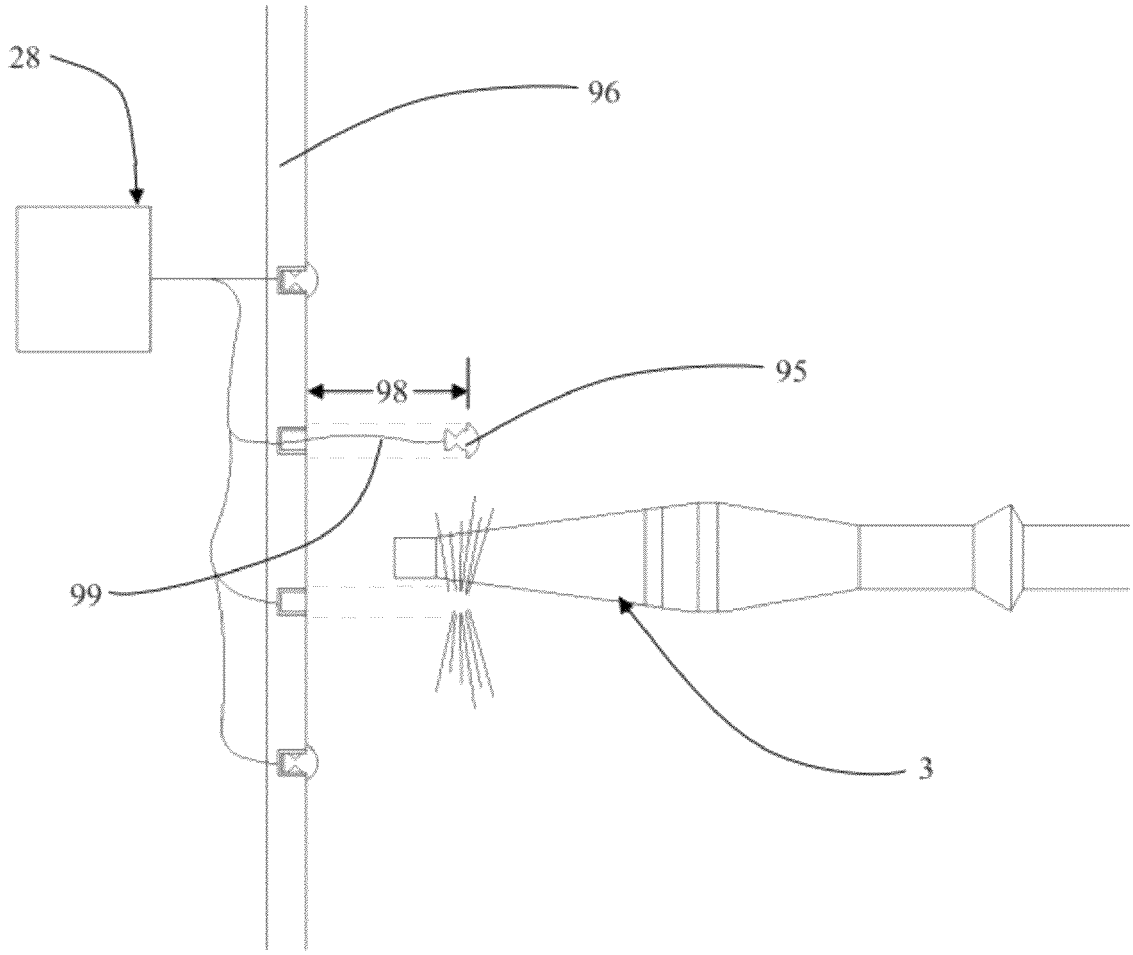
FIG. 14 illustrates a defensive arrangement of launchable shaped charges in conjunction with an incoming RPG.

FIG. 14 shows an additional embodiment of the invention wherein the standoff distance for the shaped charges in the array is achieved by launching the charge 95 from a base plate 96 containing the charge array upon sensing of the incoming threat. One or more charges is launched under timed control of the sensing system 97 to be positioned at the stand-off distance 98 for detonation to collapse in the ogive on the incoming RPG at the appropriate range. For the embodiment shown, a wireline connection 99 to the charge is employed for detonation. In alternative embodiments, a free launched timed charge is employed, however, the complexity of the charge element is increased in this embodiment.

Figure 15:
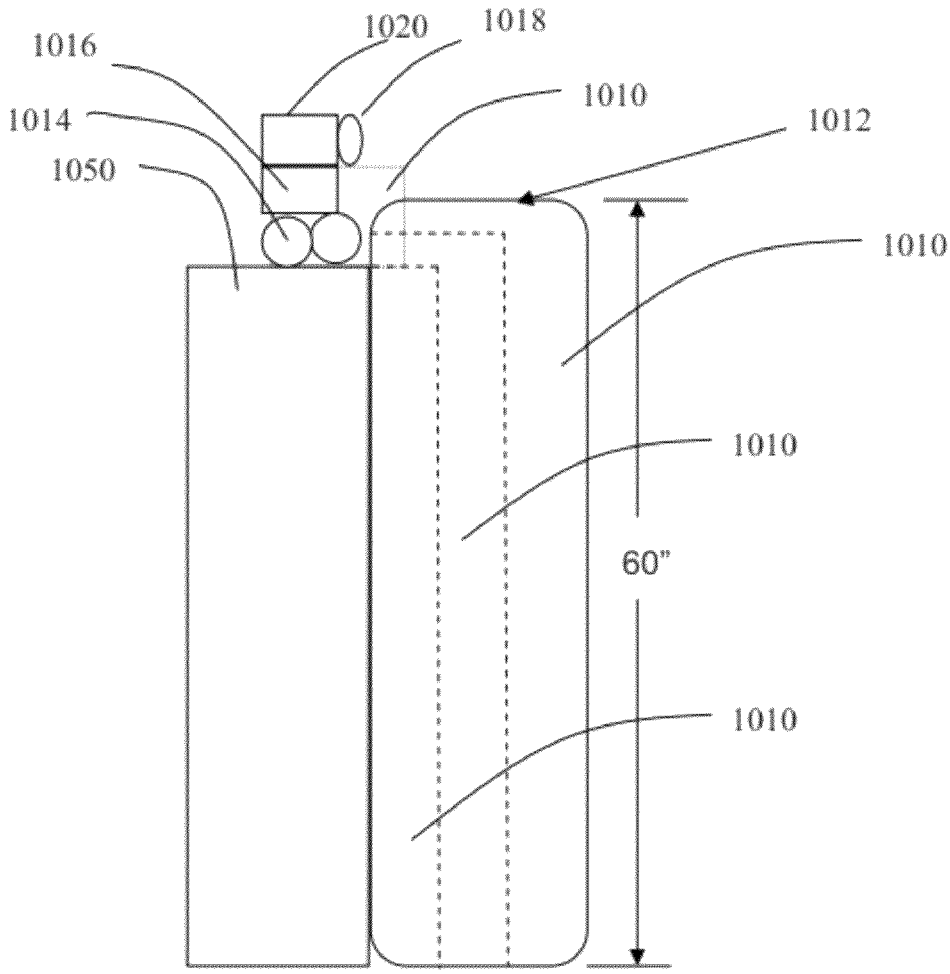
FIG. 15 is a block diagram of the components of an exemplary airbag armor system employing the present invention.

Referring to the drawings, FIG. 15 shows the basic components of an airbag armor system employing the present invention. A housing 1010 stores the deployable airbag system 1012 as well as activation components including a gas generation system 1014 and a sustaining compressor 1016. A sensor system such as a Doppler radar 1018 is mounted on or in close proximity to the housing and a signal processing and control system 1020 interconnects the sensor with the activation components. Power is provided by the vehicle alternator and electrical system or, in alternative embodiments, a self-contained battery or other electrical power generator.

Figure 16A:
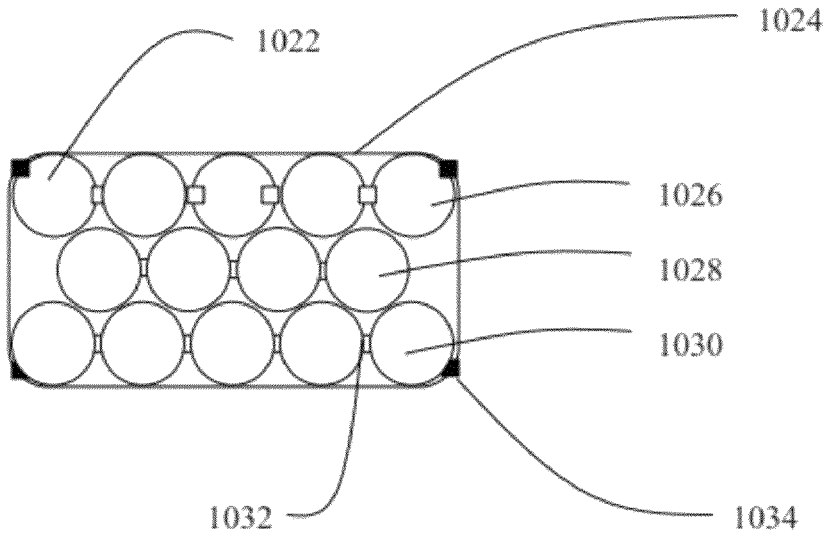
FIG. 16*a* is a top section view of a first embodiment of the airbag multiple erection columns and anti-ballistic fabric envelope.

Upon detection of an incoming threat by the sensor, the processing and control system categorizes the threat, determines if airbag deployment is warranted and, if so, initiates the gas generators to begin deployment of the airbag. Rapid inflation employing standard gas generator technology allows deployment of the system within less than 30 ms. As shown in FIG. 16*a* for a first embodiment, the airbag system incorporates multiple rows of inflation columns 1022 encompassed by a ballistic armor envelope 1024. For the embodiment shown, three rows of columns, designated 1026, 1028 and 1030 respectively, are employed with formation of the columns by stitching of seams 1032 on two sheets of bag fabric to create approximately 8 inch diameter substantially cylindrical columns upon inflation. For a current embodiment, the airbag material is 630 denier fabric 41×41 6-6 nylon 0.7 sil coat. A double needle chain stitch with 14-18 SPI thread is employed. The rows of airbag columns are not interconnected and are allowed to float, as will be described subsequently. For the embodiment shown in FIG. 16*a*, inner and outer rows of five columns and a center row of four columns are employed for coverage of a 40 inch nominal door frame opening. The envelope for the embodiment shown in the drawings comprises a Kevlar® fabric with corner attachment seams 1034 securing the envelope to the outer inflation column rows.

Figure 16B:
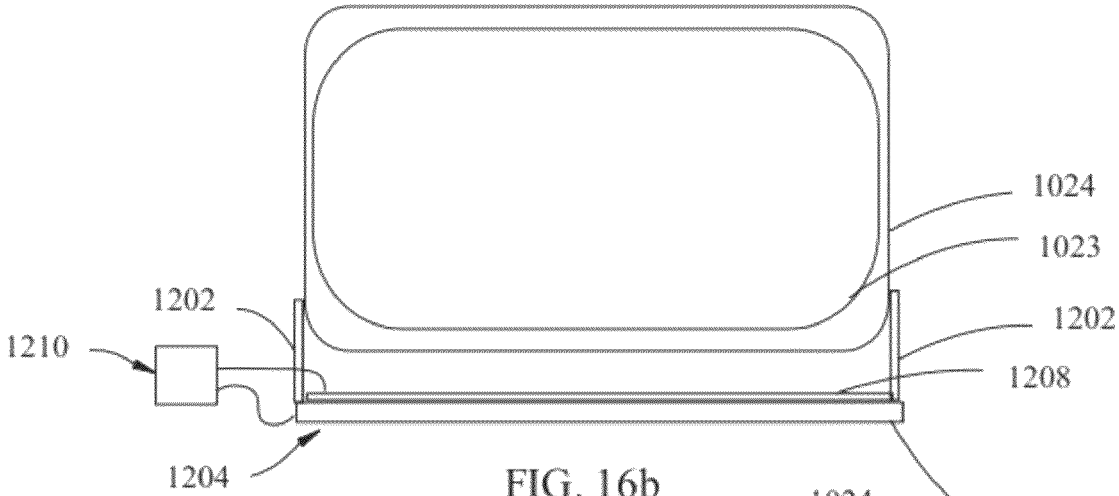
FIGS. 16*b* and 16*c* show an alternate embodiment of the airbag erection column and bag with a detonation net arrangement.
Figure 16C:
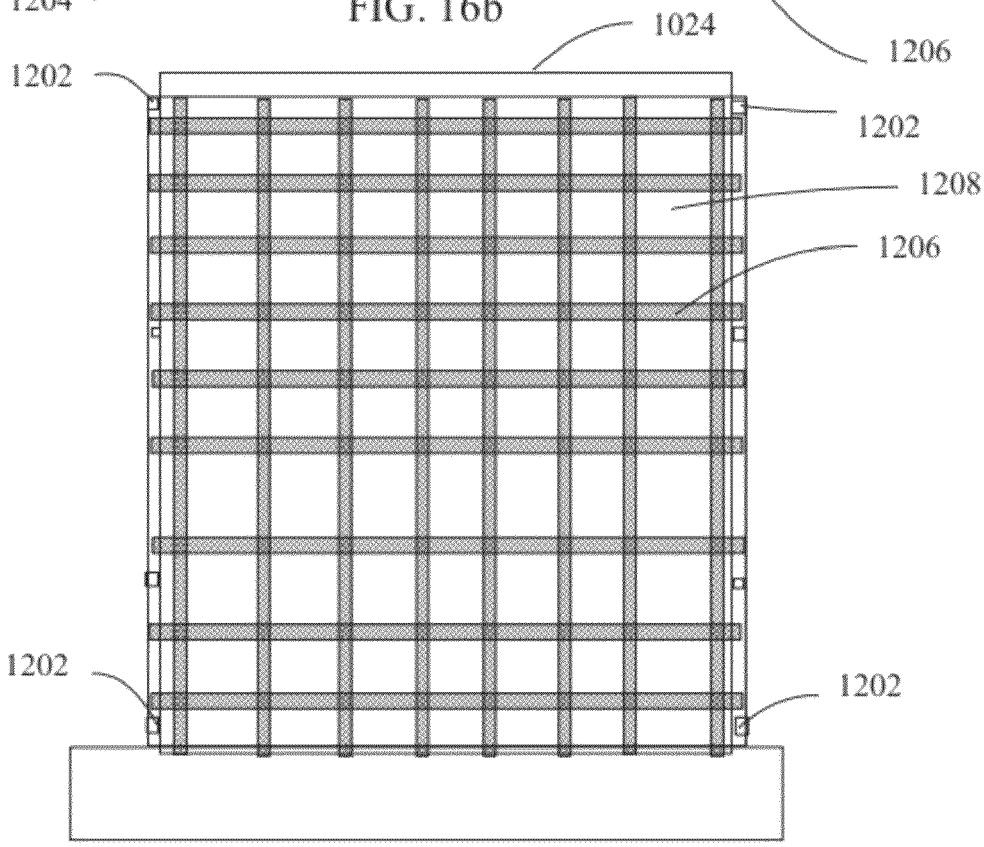

FIGS. 16*b* and 16*c* show an alternate embodiment of the airbag system with a single erection inflation column 1023 and envelope 1024. Additionally, flexible standoff supports 1202 erect in front of the Kevlar envelope during inflation to support a barrier sensing screen 1204 which incorporates a detonation net 1206 fabricated with primacord with a conductive screen backing 1208. In alternative embodiments as previously described with respect to FIG. 9 the standoff comprises a highly compliant air filled bag. For exemplary embodiments, a 6 inch square pattern with 50 grain per foot primacord has been employed. A reduced charge and/or reduced spacing geometry is employed in alternative embodiments. The nose of an RPG piercing the conductive screen is sensed by circuit 1210 which triggers detonation of the primacord net creating an explosive shock which crushes the ogive of the RPG thereby shorting the fusing circuit and rendering the round's primary fusing system inert.

The airbag erection column of the embodiment in FIGS. 16*b* and 16*c* is a rubber bladder as manufactured by Obermeyer Hydro, Inc.

Figure 17A:
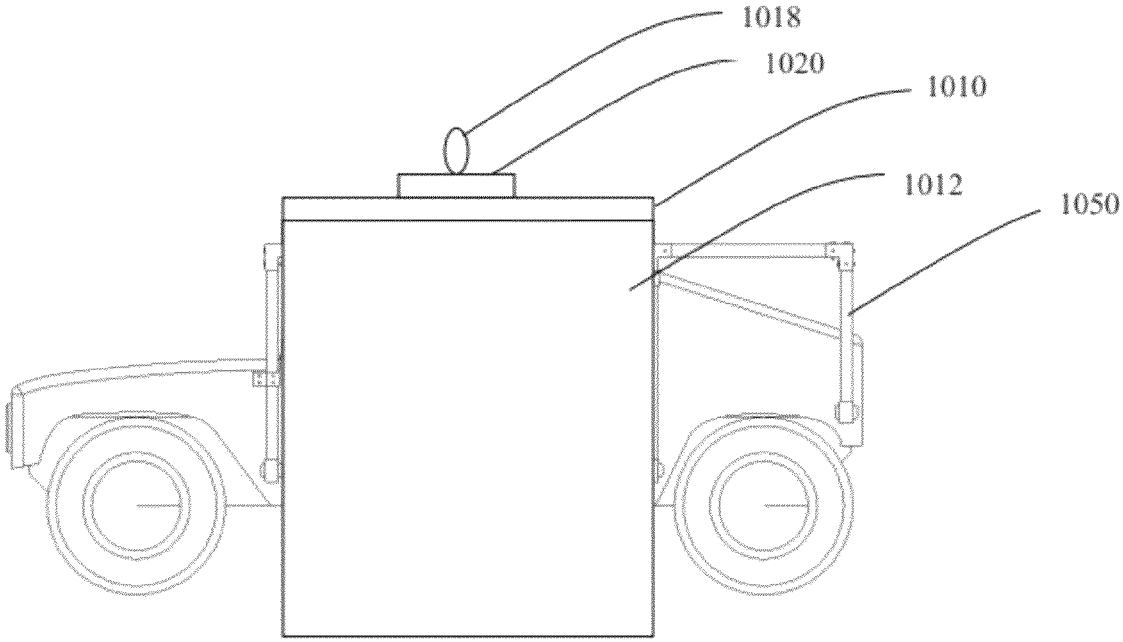
FIG. 17*a* is a side view of a M1025/1026 HMMWV showing the placement of the elements of a system employing the present invention for downward erection of the airbag system.
Figure 17B:
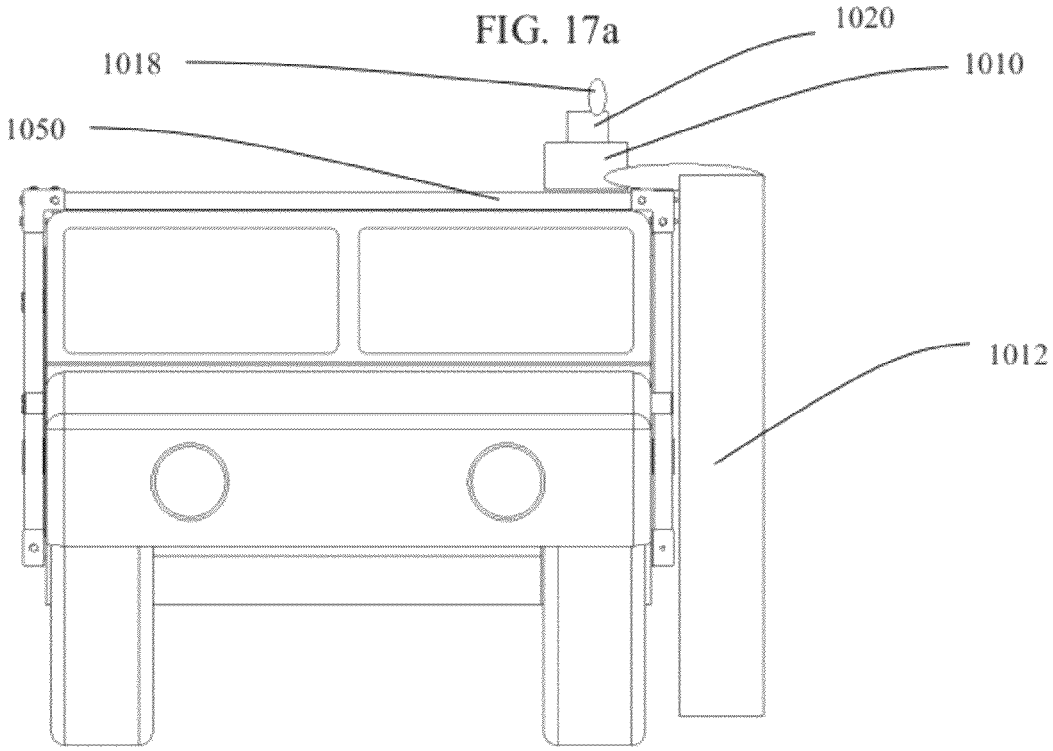
FIG. 17*b* is a front view of the HMMWV of FIG. 17*a* with the airbag armor system deployed.
Figure 17C:
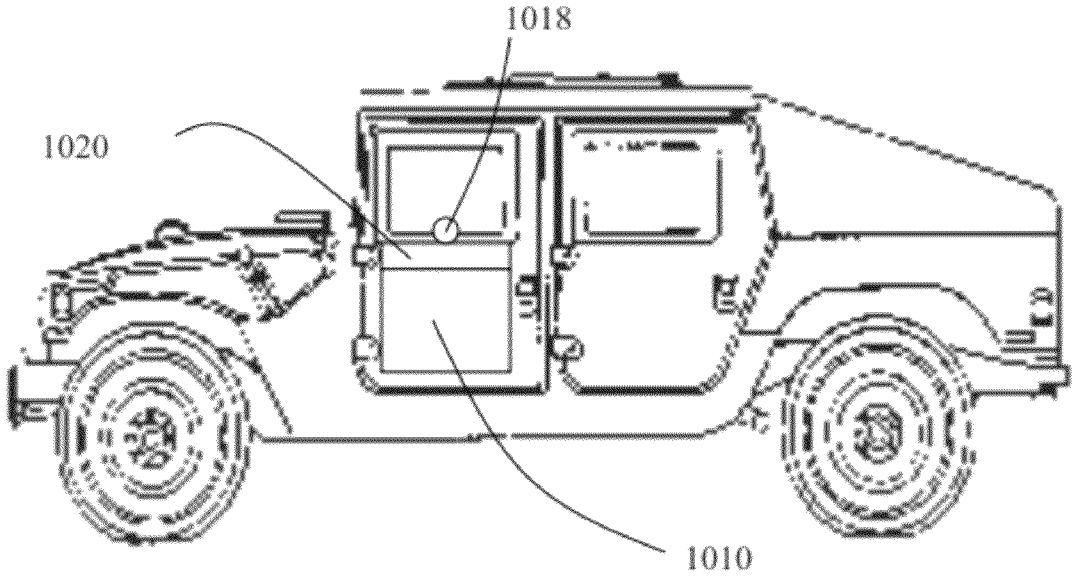
FIG. 17*c* is a side view of a M1025/1026 HMMWV showing an alternative placement of the elements of a system employing the present invention for multidirectional erection of the airbag system.
Figure 17D:
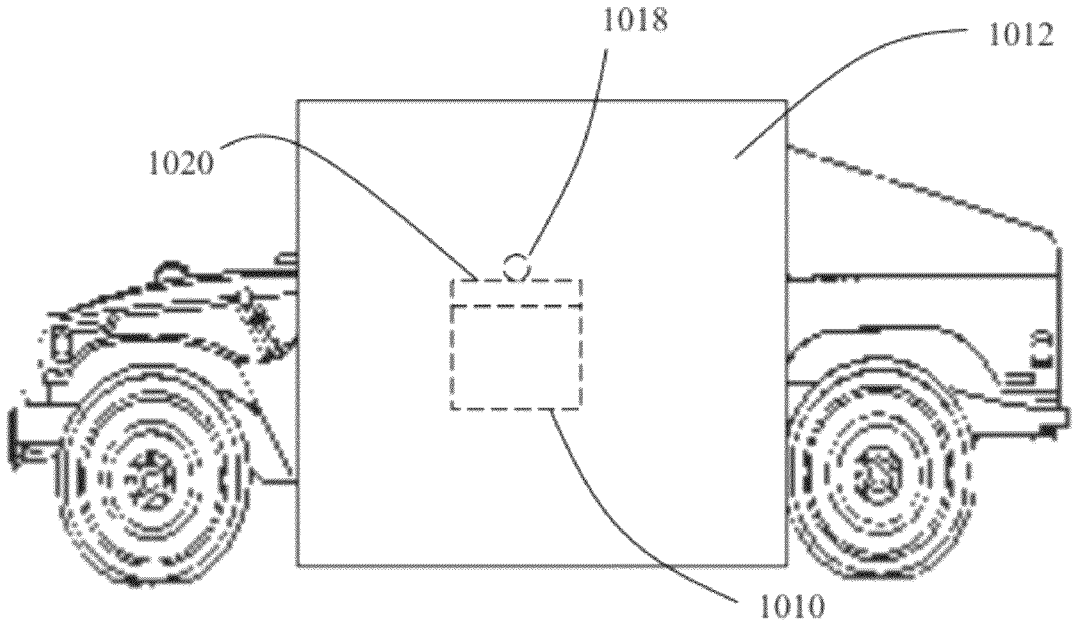
FIG. 17*d* is a side view of a M1025/1026 HMMWV showing an alternative placement of the elements of a system as shown in FIG. 17*c* with the airbag system deployed.
Figure 17E:
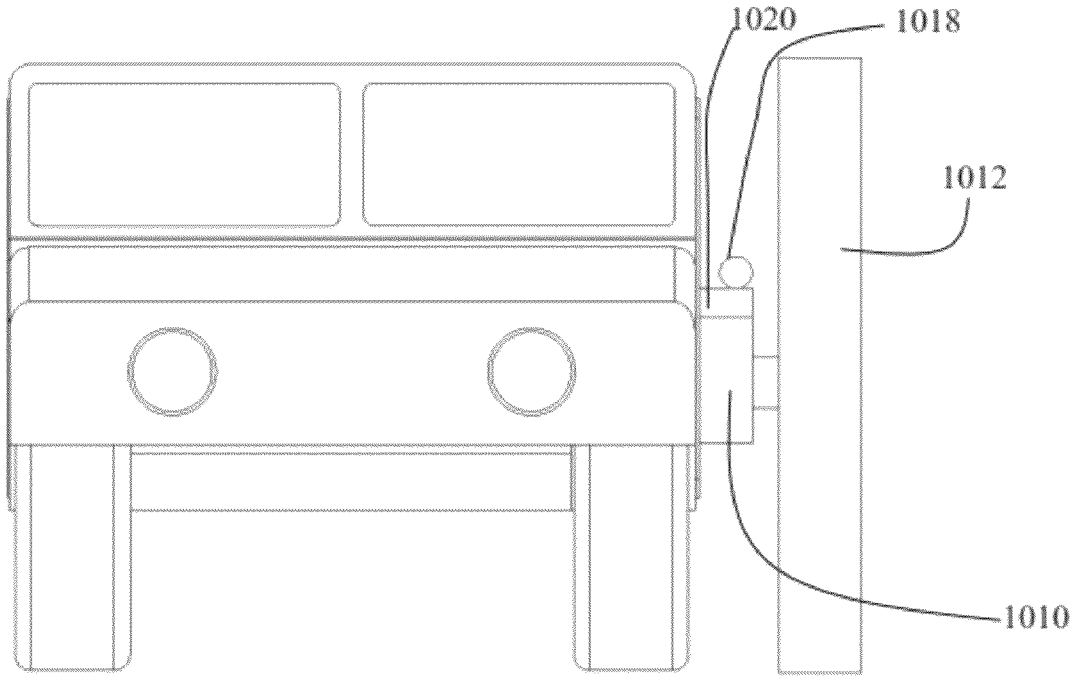
FIG. 17*e* is a front view of the system as shown in FIG. 18*d;*

The system housing is mounted to a vehicle such as an HMMWV as shown in FIG. 17*a*. The housing is attached to the vehicle frame 1050 such that when deployed and as shown in FIG. 17*b*, the air bag system substantially covers the side of the vehicle. The embodiment of FIG. 15 or 16*a-c* is ganged in multiple sets for coverage of separate door frame or an extension of the configuration by elongating the rows of gas columns and Kevlar envelope for the desired coverage. This alternative embodiment avoids issues of round penetration at the interface between the separate airbag systems. An alternative erection method for the system as shown for the embodiment in FIG. 17*c* provides erection from a modular unit capable of mounting to a door of the vehicle, his simple and modular mounting approach facilitates field installation of the system to any desired vehicle. Additionally, this embodiment of the invention facilitates egress from the vehicle after engagement of the round prior to stowing of the airbag. Mounting on the door and natural deflation of the airbag allows occupants of the vehicle to open the vehicle doors without the airbag system draped over the side of the vehicle which might impede egress. As shown in FIGS. 17*d* and 17*e*, the airbag expands vertically and horizontally from the housing to cover a door or, as in the embodiment shown, the entire side of the vehicle.

Figure 18:
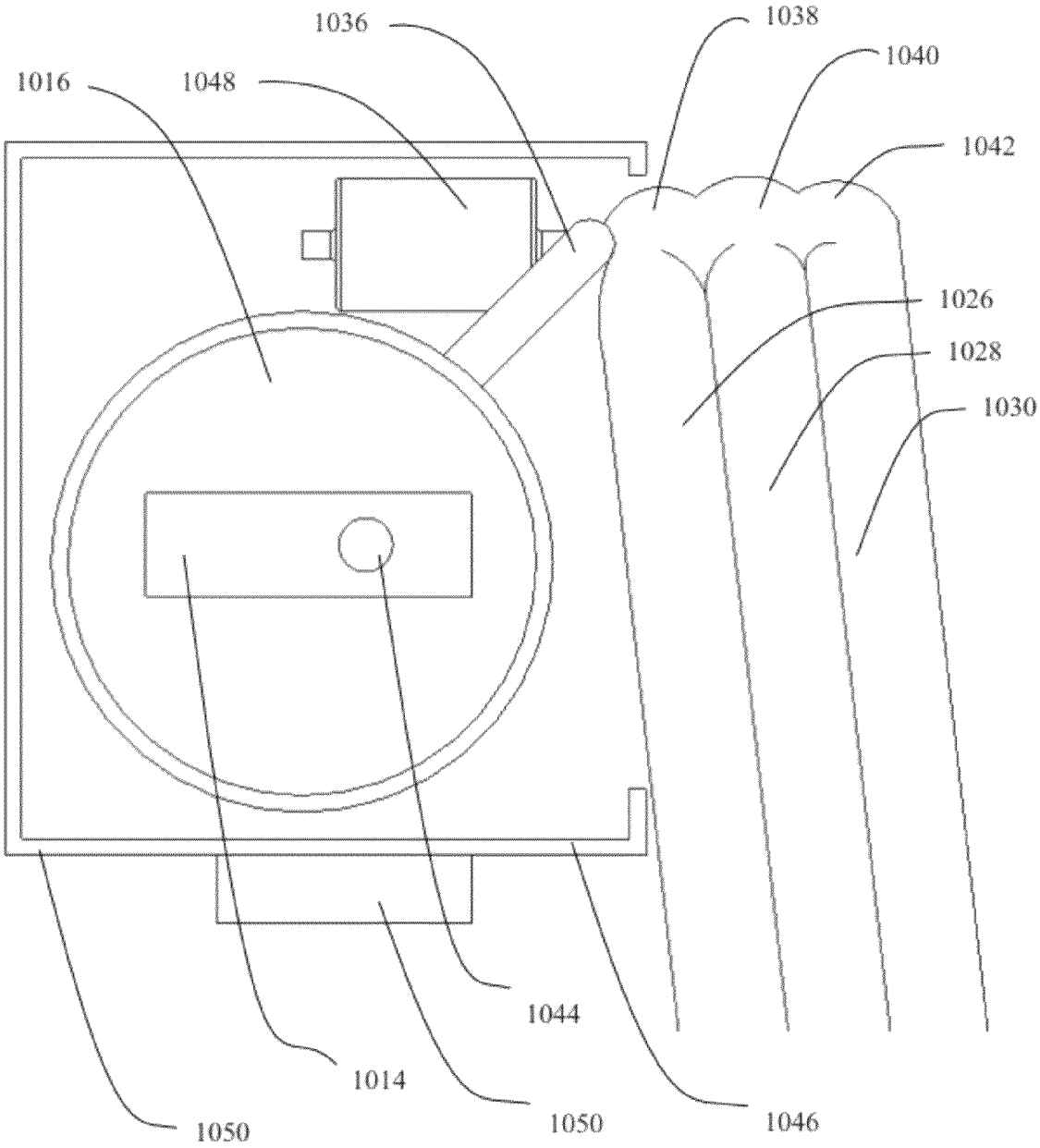
FIG. 18 is a partial side sectional detail view of the gas generator and gas bag configuration and container.

As shown in FIGS. 15 and 18, the gas generator system is directed outward from the vehicle frame 1050. As the airbag system deploys, the gas flow erects an elbow 1036 having supply conduits 1038, 1040 and 1042 feeding the rows of substantially vertical columns. As the gas generators are depleted, the processing and control system activates the compressor to maintain pressure in the airbag system. An electrically driven compressor powered from the vehicle alternator/generator system is employed in current embodiments. In various embodiments, the compressor maintains pressure for a predetermined period of time or is deactivated upon a determination by the vehicle crew that the threat has ceased and input is made into the processing and control system using a manual control 1044. Current embodiments anticipate up to 15 minutes of compressor maintained support. Upon deactivation of the compressor, pressure is depleted from the airbag system and the columns retract for reloading into the storage container 1046, which is contained in the housing, and are prepared for redeployment. As shown in FIG. 18, multiple gas generators 1048 are provided in the gas generation system for multiple deployments. The control and processing system tracks depletion of the gas generators for controlled, initiation of the next gas generator upon detection of a subsequent threat.

Figure 19:
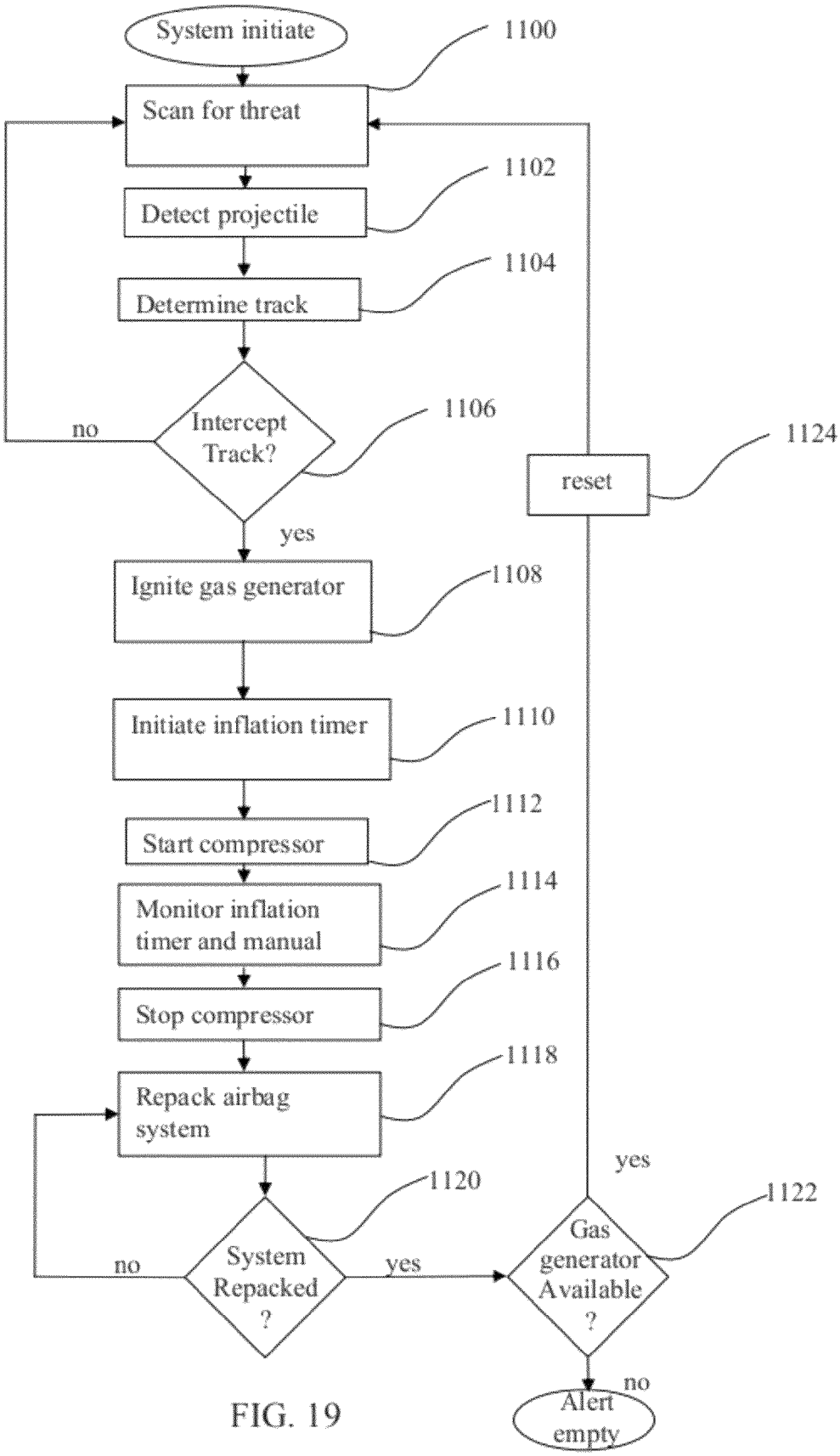
FIG. 19 is a flow chart of the detection and deployment as directed by the processing and control system.

The sensor system for the embodiment shown employs a continuous wave radar head comparable to a Decatur Radar SI2 which senses an incoming threat over a distance of approximately 100 meters with angular resolution for track determination of approximately 1 degree for calculation by the control and processing system. An alternative radar sensor using Ultra-Wide Hand (UWB) monopulse technology or pulsed emission radar systems are employed, in the system for interface to the processing and control system in alternative embodiments. As shown in FIG. 19, the processing and control system scans for threats 1100, detects a moving projectile 1102 and determines a track 1104. If the track indicates the projectile will intercept the vehicle profile 1106, the gas generators are ignited 1108 for inflation of the airbag system. An inflation timer is initiated 1110 and upon full inflation of the airbag system, the compressor is activated 1112. An activation timer is initiated and the manual deactivation control is monitored 1114 to terminate the compressor operation 1116 at the appropriate time and the airbag system is repacked 1118. Upon confirmation of system repacking 1120, the system confirms availability of gas generators 1122 then resets 1124 in preparation for the next engagement. In a simplified system, detection of a moving projectile having a signature of the RPG will initiate deployment of the system without sophisticated projectile tracking and steps 1104 and 1106 are eliminated.

Operation of the embodiments of the invention as described for light arms fire relies on the ballistic penetration strength of the envelope. In certain embodiments of the invention, the defeat of an RPG, however, employs not only the ballistic penetration resistance of the envelope but the relative thickness of the air bag system and the interactive dynamics of the multiple inflation cylinder rows to decelerate the RPG without detonation; a "soft catch", either with or without the explosive defusing previously described. Impact of the RPG in the exterior surface of the envelope results in compression of one or more columns in the external row 1026 of inflated columns. The second row 1028 of columns similarly compresses under the impact but, due to its free floating insertion between the outer row and inner row 1030, also is free to shift laterally for greater energy absorption. The inner row of columns compresses to provide the final energy absorbing element for the RPG catch. Before, during and after capture of an RPG the air bag system remains effective for deflection of small arms fire.

Figure 20A:
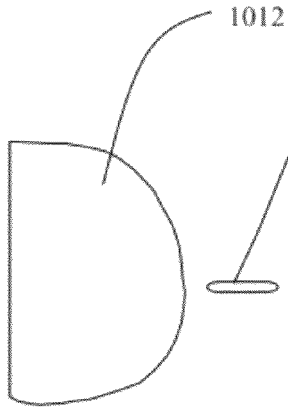
FIGS. 20*a-i* show the sequence of RPG capture by the airbag of a system employing the present invention.
Figure 20B:
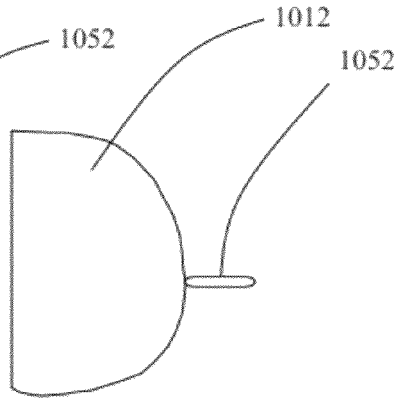
Figure 20C:
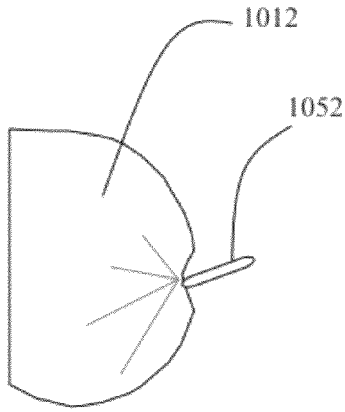
Figure 20D:
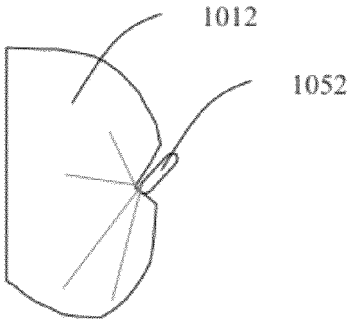
Figure 20E:
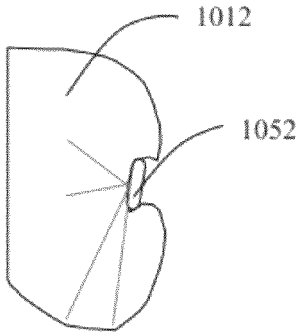
Figure 20F:
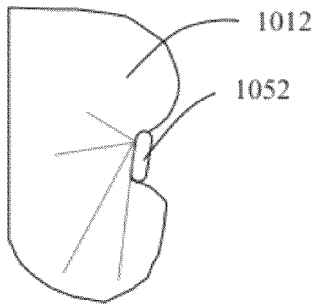
Figure 20G:
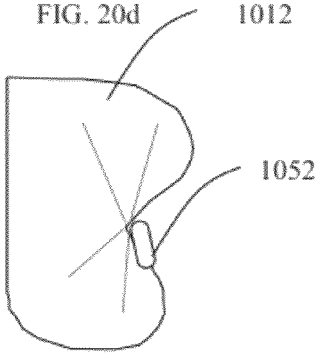
Figure 20H:
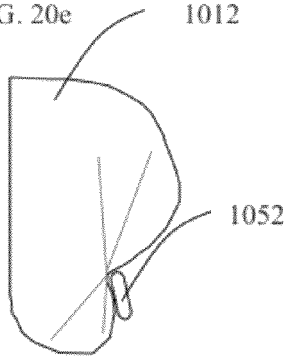
Figure 20I:
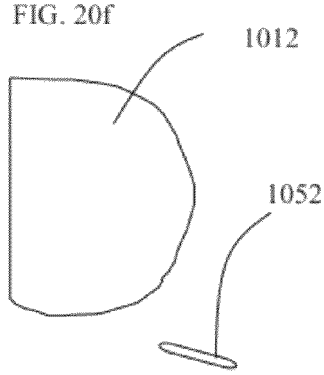

For these embodiments of the invention as shown in FIGS. 20*a-i*, the RPG 1052 is detected and the airbag armor is quickly deployed to soft catch the threat before it hits the crew compartment of the vehicle. As seen in FIG. 20*b*, As the RPG hits the airbag armor the pressure of the gas increases in all directions absorbing the energy of the rocket. Progressing to FIG. 20*c*, since the airbag armor is constrained and more rigid at the top, the compressed air causes the RPG to rotate downward into the less constrained part of the bag. FIG. 20*d* shows that the airbag armor is further compressed as more of the energy is absorbed. The bottom of the bag is forced downward by the increased pressure expanding out below the RPG. In FIG. 20*e*, the airbag armor starts wrapping around the RPG and it turns almost broadside. This causes more of the energy to be absorbed over a larger area. The airbag armor is further extended downward. As shown in FIG. 20*f*, as the airbag armor further extends downward the RPG starts sliding toward the ground. The high-g electric signal is not generated and the explosive jet is never initiated. Proceeding to FIG. 20*g*, the top of the airbag armor now begins to expand back to its original shape allowing the RPG to further slide downward and in FIG. 20*h* the RPG's downward slide continues as the upper part of the airbag armor starts to recover its original shape. Finally, as shown in FIG. 20*i*, the airbag armor returns to its original shape and the RPG falls softly to the ground allowing the vehicle to escape prior to any timed detonation of the warhead. The airbag armor remains inflated to be ready for multiple hits and to deflect small arms fire. It can be re-stowed when desired as previously described.

For the embodiment of the invention disclosed in FIG. 16*b*, the defeat of the RPG additionally employs the primacord net and sensing screen for explosive defusing of the round by crushing and shorting the ogive thereby preventing activation of the primary contact fusing system. The Kevlar envelope of the airbag system and the pressure maintained in the erection column is sufficient to impart a high-G deceleration of the RPG rendering the secondary timeout fuse of the round inoperative thereby completely inerting the round.

Figure 21:
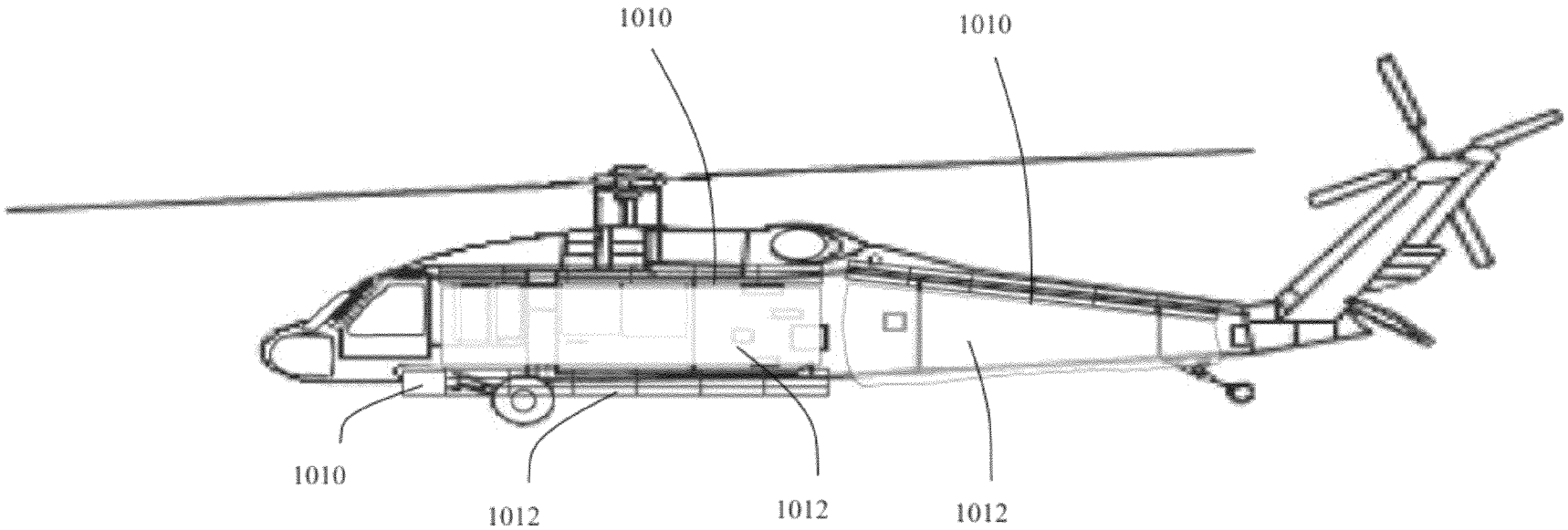
FIG. 21 is aside view of an application of a system employing the current invention to a helicopter for crew compartment, tail boom structure and fuselage belly protection; and, FIGS. 22*a* and 22*b* are views of a launchable detonation net in stowed configuration.

The airbag armor system employing the present invention is also applicable for helicopter protection as shown in FIG. 21. Airbag armor systems housings 1010 are mounted to the aircraft over the crew/passenger compartment, under the fuselage belly and the tail boom. At hover or low speed, sensing of a RPG or SAM results in deployment of the airbag armor 1012 to deflect the incoming missile as described previously with respect to the ground vehicle application. For the fuselage belly application, any forward airspeed of the aircraft assists in flattening the airbag system against the belly assisting the normal inflation direction of the system perpendicular to the housing (in this case horizontally).

Figure 22A:
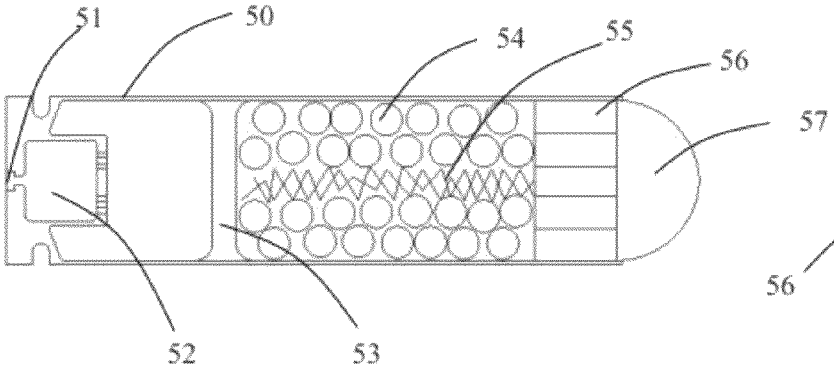
FIG. 22*c* is the launched and deployed configuration of the detonation net of FIGS. 22*a* and 22*b*.
Figure 22B:
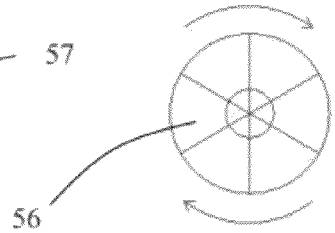
Figure 22C:
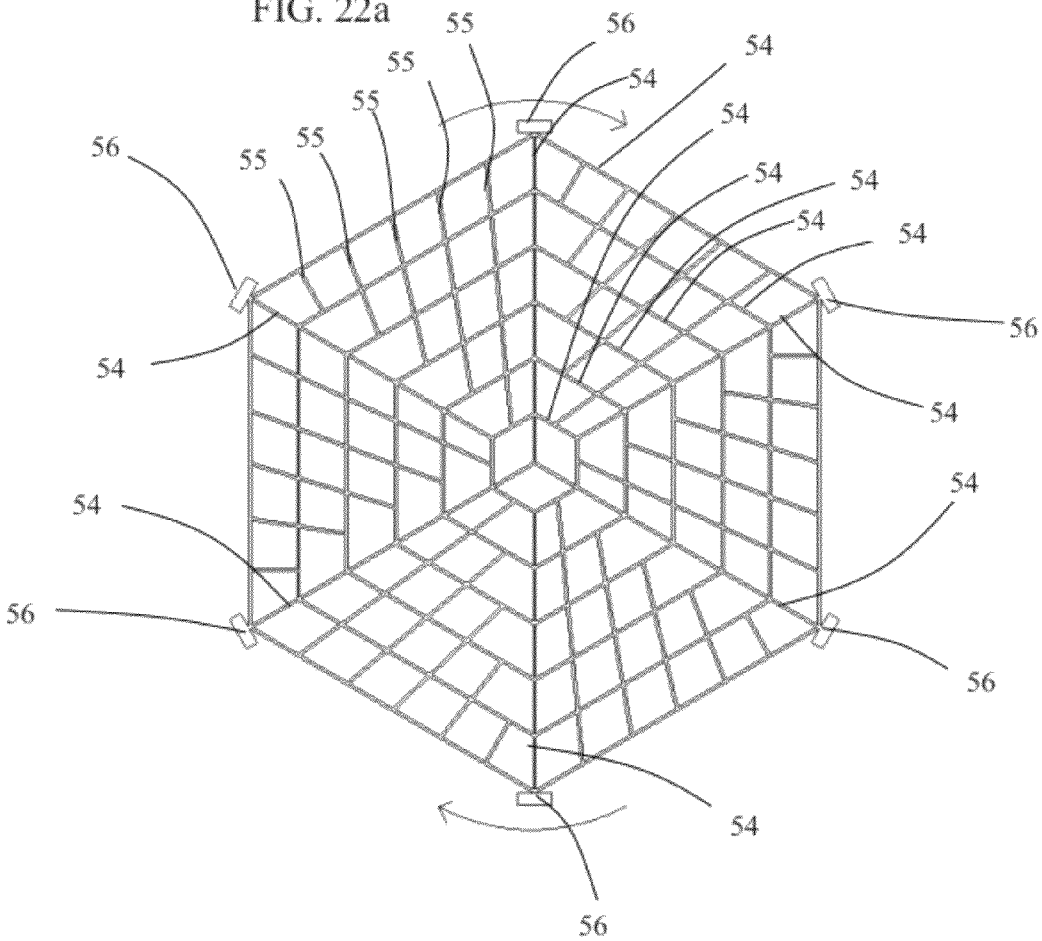

FIGS. 22*a*, 22*b* and 22*c* are views of yet an another alternative embodiment of the detonation net wherein the entire net or array is launched in response to the incoming threat. The illustrated embodiment uses a grenade launching cartridge 50 containing propellant 52 primer 51 and plastic sleeve (wadding) 53. Plastic sleeve 53 in turn contains detonation net 54 which further includes break screen elements 55 and detonator assemblies 56. The detonator assemblies include power supplies, break screen circuits, safe/arm means and primacord detonators. Detonator assemblies are locked in safe mode when adjacent to each other prior to launch for the embodiment shown. The detonator assemblies are launched through a rifled barrel and, upon exiting the barrel, the centripetal force acting on the spinning assembly causes deployment of the detonation net and break screen assembly and arming of the detonation assemblies 56. Protective cap 57 is inert and provides protection of the assemblies prior to launch.

Having now described the invention in detail as required by the patent statutes, those skilled in the art will recognize modifications and substitutions to the specific embodiments disclosed herein. Patents, publications, or other references mentioned in this application for patent are hereby incorporated by reference. In addition, as to each term used it should be understood that unless its utilization in this application is inconsistent with such interpretation, both traditional and common dictionary definitions should be understood as incorporated for each term and all definitions, alternative terms, and synonyms such as contained in the Random House Webster's Unabridged Dictionary, second edition are hereby incorporated by reference. Thus, the applicant(s) should be understood to claim at least: i) each of the control devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the elements disclosed, xi) each potentially dependent claim or concept as a dependency on each and every one of the independent claims or concepts presented, and xxii) the various combinations and permutations of each of the above.

It should also be understood that for practical reasons and so as to avoid adding potentially hundreds of claims, the applicant presents claims with initial dependencies only. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. While the embodiments are disclosed for use on a vehicle, the armored airbag system of the present invention is applicable to stationary structures, boats or other targets susceptible to attack by RPGs. Such modifications are within the scope and intent of the present invention as summarized below. The term RPG as used in this application is intended to be broadly construed to include not only conventional rocket propelled grenades, but also any threat which may be disabled by means of this invention, including Tube launched Optically tracked Wire guided (TOW) missiles, heat seeking missiles, torpedoes, robots, infantry, suicide bombers, anti-tank guided missiles (ATGMs), mortars, man portable air defense systems, (MANPADS), tank launched rounds such as HEAT rounds, or other threats, it should be understood that the efficacy of this invention with respect to any particular category of threat or hardened version of any threat may be dependent upon the explosive power incorporated into such embodiment. Although embodiments of this invention with only sufficient explosive power to disable conventional RPGs such as the PG-7 may be advantageous from a dismounted troop safety standpoint, the explosive power intended by this invention should not be construed to be limited except by that explosive power which may be required to disable or usefully degrade a threat against which the system of this invention may be used or designed.

APPENDIX A

REFERENCES TO BE INCORPORATED BY REFERENCE IN ACCORDANCE WITH THE PROVISIONAL APPLICATION

| DOCUMENT NO | DATE | NAME | CLASS | SUBCLASS |
|---|---|---|---|---|
| 1. U.S. PATENT DOCUMENTS | | | | |
| 6,676,785 | Jan. 13, 2004 | Johnson et al. | 156 | 92 |
| 6,645,610 | Nov. 11, 2003 | Reis et al. | 428 | 297 |
| 6,645,333 | Nov. 11, 2003 | Johnson et al. | 156 | 92 |
| 6,612,523 | Sep. 2, 2003 | Gardner | 244 | 117 |
| 6,436,507 | Aug. 20, 2002 | Pannell | 428 | 102 |
| 6,291,047 | Sep. 18, 2001 | Kunkel et al | 428 | 99 |
| 6,268,049 | Jul. 31, 2001 | Childress | 428 | 309 |
| 6,190,602 | Feb. 20, 2001 | Blaney et al. | 264 | 443 |
| 6,051,089 | Apr. 18, 2000 | Palmer et al | 156 | 92 |
| 6,027,798 | Feb. 22, 2000 | Childress | 428 | 319.3 |
| 5,980,665 | Nov. 9, 1999 | Childress | 156 | 92 |
| 5,972,524 | Oct. 26, 1999 | Childress | 428 | 615 |
| 5,968,639 | Oct. 19, 1999 | Childress | 428 | 233 |
| 5,958,550 | Sep. 28, 1999 | Childress | 428 | 119 |
| 5,935,698 | Aug. 10, 1999 | Pannell | 428 | 223 |
| 5,935,475 | Aug. 10, 1999 | Scoles et al | 219 | 633 |
| 5,935,680 | Aug. 10, 1999 | Childress | 428 | 119 |
| 5,919,413 | Jul. 6, 1999 | Avila | 264 | 249 |
| 5,916,649 | Jun. 29, 1999 | Scoles et al | 219 | 633 |
| 5,882,756 | Mar. 16, 1999 | Alston et al. | 428 | 63 |
| 5,876,832 | Mar. 2, 1999 | Pannell | 428 | 119 |
| 5,876,652 | Mar. 2, 1999 | Rorabaugh et al | 264 | 258 |
| 5,876,540 | Mar. 2, 1999 | Pannell | 156 | 91 |
| 5,869,165 | Feb. 9, 1999 | Rorabaugh et al | 428 | 105 |
| 5,868,886 | Feb. 9, 1999 | Alston et al. | 156 | 98 |
| 5,863,635 | Jan. 26, 1999 | Childress | 428 | 119 |
| 5,862,975 | Jan. 26, 1999 | Childress | 228 | 120 |
| 4,090,092 | May 16, 1978 | Serraro | 307 | 116 |
| 4,136,291 | Jan. 23, 1979 | Waldron | 307 | 308 |
| 4,145,748 | Mar. 20, 1979 | Eichelberger, et al. | 364 | 862 |
| 4,158,216 | Jun. 12, 1979 | Bigelow | 361 | 280 |
| 4,233,522 | Nov. 11, 1980 | Grummer, et al. | 307 | 116 |

APPENDIX A-continued

REFERENCES TO BE INCORPORATED BY REFERENCE IN ACCORDANCE WITH THE PROVISIONAL APPLICATION

| DOCUMENT NO | DATE | NAME | CLASS | SUBCLASS |
|---|---|---|---|---|
| 4,264,903 | Apr. 28, 1981 | Bigelow | 340 | 365 |
| 4,293,987 | Oct. 13, 1981 | Gottbreht, et al. | 29 | 25.42 |
| 4,304,976 | Dec. 8, 1981 | Gottbreht, et al. | 219 | 10.55 |
| 4,394,643 | Jul. 19, 1983 | Williams | 340 | 365 |
| 4,561,002 | Dec. 24, 1985 | Chin | 340 | 365 |
| 4,853,498 | Aug. 1, 1989 | Meadows, et al. | 178 | 19 |
| 4,855,550 | Aug. 8, 1989 | Schultz, et al. | 200 | 600 |
| 4,894,493 | Jan. 16, 1990 | Smith, et al. | 200 | 5A |
| 4,922,061 | Jan. 16, 1990 | Meadows, et al. | 178 | 19 |
| 5,276,294 | Jan. 4, 1994 | Jalbert | 187 | 121 |
| 5,283,559 | Feb. 1, 1994 | Kalendra, et al. | 345 | 168 |
| 5,457,289 | Oct. 10, 1995 | Huang, et al. | 178 | 20 |
| 5,488,204 | Jan. 30, 1996 | Mead, et al. | 178 | 18 |
| 5,526,294 | Jun. 11, 1996 | Ono, et al. | 364 | 709.13 |
| 5,548,306 | Aug. 20, 1996 | Yates, IV, et al. | 345 | 174 |
| 5,650,597 | Jul. 22, 1997 | Redmayne | 178 | 19 |
| 5,729,249 | Mar. 17, 1998 | Yasutake | 345 | 173 |
| 5,970,107 | Aug. 4, 1998 | Kasser, et al. | 345 | 174 |
| 5,880,718 | Mar. 9, 1999 | Frindle, et al. | 345 | 174 |
| 5,920,309 | Jul. 6, 1999 | Bisset, et al. | 345 | 173 |
| 6,094,491 | Jul. 25, 2000 | Frindle, et al. | 381 | 119 |
| II FOREIGN PATENT DOCUMENTS | | | | |
| EP 0 054 306 | 16 Dec. 1981 | Europe | H03K 17 | 96 |
| EP 0 567 364 15 | 06 Apr. 1993 | Europe | G06K 11 | 16 |
| EP 0745 928 13 | 04 Dec. 1996 | Europe | G06F 3 | 33 |
| EP 0 727 875 15 | 15 Jan. 1996 | Europe | H03K 17 | 96 |
| EP 0 720 293 12 | 19 Dec. 1995 | Europe | H03K 17 | 96 |
| EP 0 917 291 13 | 15 Jan. 1996 | Europe | H03K 17 | 96 |
| WO 00/02701 | 20 Jan. 2000 | PCT | 163Q 1 | 25 |
| WO 01/33540 | 10 May 2001 | PCT | G09G 5 | 8 |

What is claimed is:

1. An explosive round countermeasure system comprising:

a plurality of bi-directional linear shaped charges;

standoffs for holding the linear shaped charges in parallel spaced relation and the spaced linear shaped charges distal from the structure to be protected, each shaped charge creating a substantially planar jet in each direction when detonated;

a radar for sensing an incoming explosive round having a nose mounted fuse structure; and, a break screen interconnected to a plurality of detonators for detonating at least one of the charges in the array responsive to the radar such that the detonation is timed for placement of the fuse structure adjacent the at least one charge.

2. The countermeasure system as defined in claim 1 wherein the planar jet is created at an angle in front of the array.

3. The countermeasure system as defined in claim 1 wherein the break screen comprises an optical brake screen.

4. The countermeasure system as defined in claim 1 wherein the break screen comprises break screen elements supported on a flexible substrate.

5. The countermeasure system as defined in claim 1 wherein the break screen comprises electrical contact regions supported on a flexible substrate.

6. The countermeasure system as defined in claim 1 wherein the break screen comprises break screen elements held in relative position by and supported by spacing elements.

7. The countermeasure system as defined in claim 6 wherein the spacing elements comprise nylon ties.

8. The counter measure system as defined in claim 1 wherein the radar is activated by a launch detector.

9. The counter measure system as defined in claim 8 wherein the launch detector is selected from the set of an infrared sensor, an acoustic sensor and a radio frequency sensor.

* * * * *